US007832900B2

(12) United States Patent
Avitan

(10) Patent No.: US 7,832,900 B2
(45) Date of Patent: Nov. 16, 2010

(54) LIGHTBULB WITH ENVELOPE-FRACTURE RESPONSIVE ELECTRICAL DISCONNECT MEANS

(76) Inventor: Simon Avitan, 31-05 Heywood Ave., Fair Lawn, NJ (US) 07410

( * ) Notice: Subject to any disclaimer, the term of this patent is extended or adjusted under 35 U.S.C. 154(b) by 132 days.

(21) Appl. No.: 12/170,647

(22) Filed: Jul. 10, 2008

(65) Prior Publication Data

US 2010/0226115 A1 Sep. 9, 2010

(51) Int. Cl.
*H01K 1/64* (2006.01)

(52) U.S. Cl. ..... 362/265; 362/295; 362/253; 362/802; 313/580; 315/74

(58) Field of Classification Search ..... 362/265, 362/295, 20, 254, 253, 802; 315/73, 74; 313/580
See application file for complete search history.

(56) References Cited

U.S. PATENT DOCUMENTS

| | | | | | |
|---|---|---|---|---|---|
| 491,992 | A | * | 2/1893 | Edison | 315/75 |
| 1,102,009 | A | * | 6/1914 | Csanyi | 362/21 |
| 3,767,965 | A | * | 10/1973 | Collins et al. | 315/75 |
| 3,845,260 | A | * | 10/1974 | Lohr | 200/83 N |
| 3,944,769 | A | * | 3/1976 | Wagner | 200/83 A |
| 4,013,920 | A | | 3/1977 | Petro | |
| 4,032,816 | A | | 6/1977 | Rokosz | |
| 4,039,893 | A | | 8/1977 | Corbley | |
| 4,143,301 | A | | 3/1979 | Strauss | |
| 4,145,588 | A | * | 3/1979 | Orcutt | 200/83 P |
| 4,156,830 | A | * | 5/1979 | Strauss et al. | 315/73 |
| 4,186,327 | A | * | 1/1980 | Petro | 315/73 |
| 4,195,251 | A | * | 3/1980 | Bamberg | 315/73 |
| 4,205,258 | A | * | 5/1980 | Ward | 315/73 |
| 4,217,522 | A | * | 8/1980 | Strauss | 315/73 |
| 4,221,993 | A | * | 9/1980 | Phillipp et al. | 315/73 |
| 4,229,678 | A | * | 10/1980 | Petro | 315/73 |
| 4,292,484 | A | * | 9/1981 | Pruss | 200/61.25 |
| 4,388,557 | A | * | 6/1983 | Shaffer | 315/74 |
| 4,390,811 | A | | 6/1983 | Rothwell et al. | |
| 4,417,177 | A | * | 11/1983 | Damiano | 315/73 |
| 4,629,939 | A | * | 12/1986 | Jaworowicz et al. | 315/73 |
| 4,695,681 | A | * | 9/1987 | Velleman | 200/5 A |
| 4,752,718 | A | | 6/1988 | Strauss et al. | |
| 4,973,881 | A | | 11/1990 | Haraden et al. | |
| 5,028,749 | A | * | 7/1991 | Hodate | 200/61.25 |
| 6,462,478 | B1 | * | 10/2002 | Oetken et al. | 315/73 |
| 6,570,327 | B1 | * | 5/2003 | Pinot et al. | 313/580 |
| 6,577,065 | B2 | * | 6/2003 | Kling | 315/56 |
| 6,737,803 | B2 | | 5/2004 | Slot et al. | |

* cited by examiner

*Primary Examiner*—Ismael Negron
(74) *Attorney, Agent, or Firm*—Katten Muchin Rosenman LLP

(57) ABSTRACT

A safety lightbulb includes a base, a glass envelope connected to the base, and electrical contacts extending from the base into the glass envelope and electrically connected to a filament for producing light in the glass envelope when current is supplied to the electrical contacts from a power source to which the base is connected. A safety arrangement in the base automatically electrically disconnects the electrical contacts from the power source when the glass envelope is broken, and includes an electrical contact member in the base and a moving/restraining arrangement in the base for moving the electrical contact members out of electrical contact with the power source and the electrical contacts, when the glass envelope is broken.

6 Claims, 21 Drawing Sheets

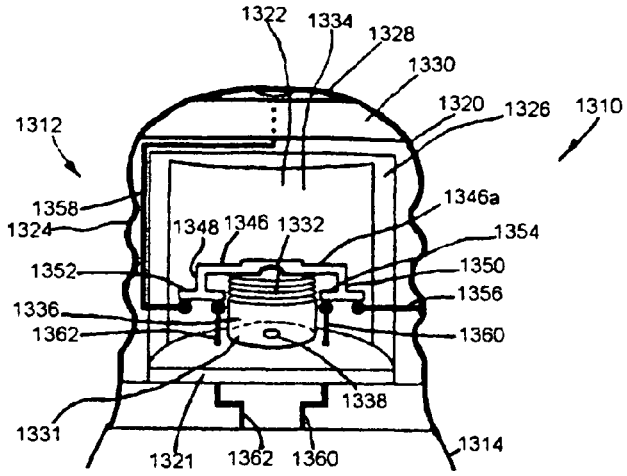
FIG. 17A
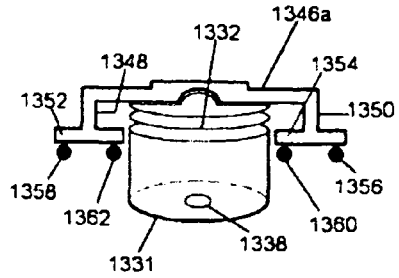
FIG.17C
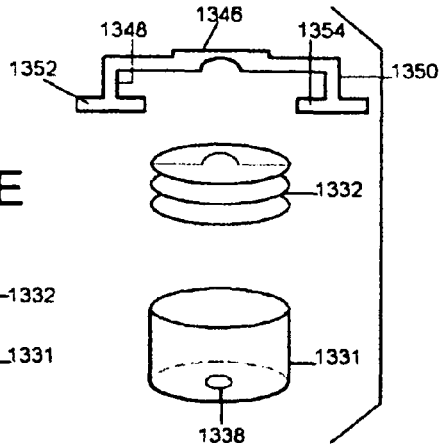
FIG. 17E
FIG. 17D
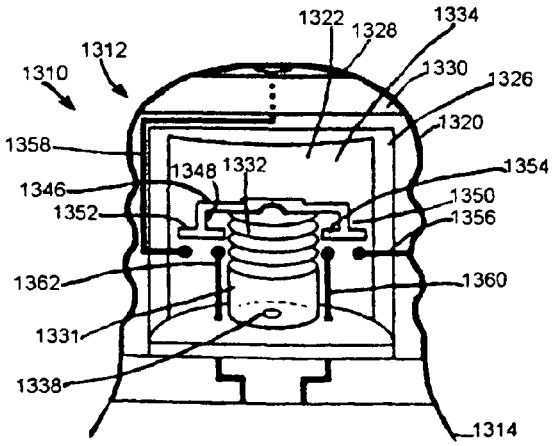
FIG. 17B
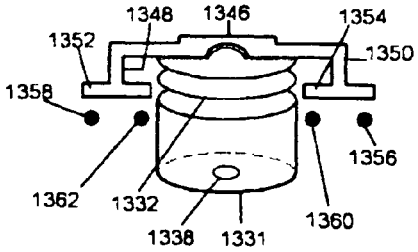
FIG. 17F FIG. 21
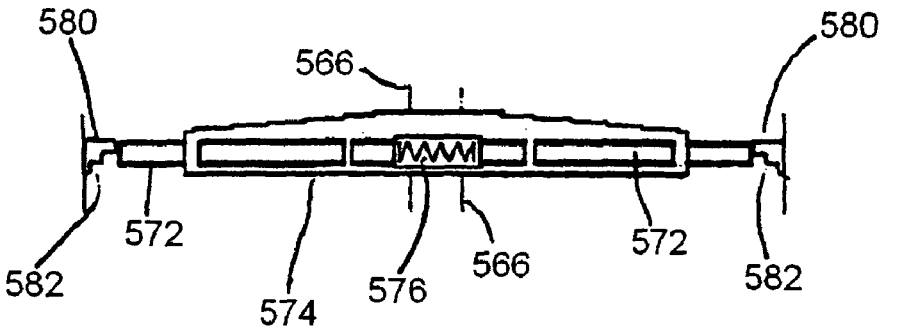
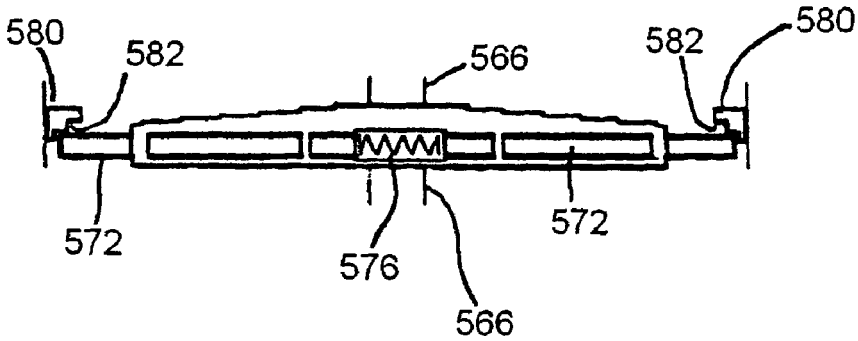
FIG. 22

LIGHTBULB WITH ENVELOPE-FRACTURE RESPONSIVE ELECTRICAL DISCONNECT MEANS

BACKGROUND OF THE INVENTION

The present invention relates generally to lightbulbs, and more particularly, is directed to a safety lightbulb that does not present any danger of electrical shock when the glass envelope breaks.

A lightbulb, whether incandescent or fluorescent, includes a base which is physically and electrically connected to a socket. Wiring and/or filaments extend outwardly from the base, and a glass envelope surrounds the wiring and/or filaments.

However, when a lightbulb breaks or shatters, the wiring and/or filaments are no longer covered by the glass envelope, and are thereby exposed. If they are still electrically connected to the power source, this can result in a shock to a person who accidentally touches the wiring and/or filaments. This is especially dangerous for young children that accidentally break a bulb.

In addition, if the light itself falls and the glass breaks, the contacts may contact each other and cause a spark, which can result in flammable objects catching fire.

SUMMARY OF THE INVENTION

Accordingly, it is an object of the present invention to provide a safety lightbulb that overcomes the aforementioned problems.

It is another object of the present invention to provide a safety lightbulb that automatically electrically disconnects the wiring and filaments from the power source so that no current is supplied thereto once the lightbulb breaks.

It is still another object of the present invention to provide a safety lightbulb of the above type in which the disconnection from the power source occurs in the base of the lightbulb.

In accordance with an aspect of the present invention, a safety lightbulb includes a base, a glass envelope connected to the base, at least one electrical contact extending from the base into the glass envelope, an arrangement for producing light in the glass envelope when current is supplied to the at least one electrical contact from a power source to which the base is connected, and a safety arrangement in the base which automatically electrically disconnects the at least one electrical contact from the power source when the glass envelope is broken.

The safety arrangement includes an electrical contact member in the base and which is moved out of electrical contact with the power source, and/or at least one the electrical contact, when the glass envelope is broken. The power source includes at least one electrical power lead extending into the base.

The safety arrangement includes a moving/restraining arrangement in the base for moving the electrical contact member out of electrical contact with at least one the electrical power lead, and/or at least one the electrical contact, when the glass envelope is broken.

In one embodiment, the moving/restraining arrangement includes a membrane in the base which divides an interior of the base into first and second chambers. The membrane engages the electrical contact member. The second chamber is in fluid communication though an opening with the glass envelope, and the first chamber is at a greater pressure than the second chamber. As a result, in normal operation of the lightbulb, current is supplied to the electrical contacts from the at least one electrical lead, but when the glass envelope breaks, the second chamber is fluidly connected with ambient atmosphere which causes the membrane to move the electrical contact member out of electrical contact with at least one electrical power lead, and/or at least one the electrical contact.

In this embodiment, the safety arrangement further includes a spring in the base which functions to bias the membrane with a spring force in a direction to move the electrical contact member out of electrical contact with at least one the electrical power lead, and/or at least one the electrical contact, but which spring force is less than a differential pressure between the first and second chambers in normal operation. In one variation, the spring and the electrical contact member are positioned in the second chamber. In another variation, the spring is positioned in the second chamber and the electrical contact member is positioned in the first chamber.

In accordance with a modification of the first embodiment, the at least one electrical contact includes a first electrical contact lead and a second electrical contact lead, and the electrical contact member includes a first contact arm for electrically contacting the first electrical contact lead and a second contact arm for electrically contacting the second electrical contact lead during normal operation of the safety lightbulb. The at least one electrical power lead includes first and second electrical power leads connected to the power source, with the first contact arm electrically contacting the first power lead and the second contact arm electrically contacting the second power lead during normal operation of the safety lightbulb. The moving/restraining arrangement moves the first and second contact arms of the electrical contact member out of electrical contact with the first and second power leads and out of contact with the first and second electrical contact leads, when the glass envelope is broken.

In another modification of the first embodiment, the electrical contact member includes a first contact arm and a second contact arm, and the at least one electrical contact includes first and second electrical contacts extending into the electrical contact member. The first contact arm includes an electrical contact plate electrically connected with the first electrical contract and electrically contacting the first electrical power lead during normal operation of the safety lightbulb, and the second contact arm includes an electrical contact plate electrically connected with the second electrical contact and electrically contacting the second electrical power lead during normal operation of the safety lightbulb.

In another modification of the first embodiment, the moving/restraining arrangement includes a housing in the base which divides an interior of the base into a first chamber exterior of the housing and a second chamber within the housing. The housing includes a first end connected to a wall of the base which separates the base from the glass envelope and a second end engaging the electrical contact member. At least one wall of the housing is movable. The second chamber is in fluid communication though an opening with the glass envelope and the first chamber is at a greater pressure than the second chamber. Thus, in normal operation of the lightbulb, current is supplied to the electrical contacts from the power source, but when the glass envelope breaks, the second chamber is fluidly connected with ambient atmosphere which causes the at least one wall of the housing to move the electrical contact member out of electrical contact with at least one the electrical power lead, and/or at least one the electrical contact.

In this modification, the safety arrangement further includes a spring in the housing which functions to bias the electrical contact member with a spring force in a direction to move the electrical contact member out of electrical contact with at least one the electrical power lead, and/or at least one the electrical contact, but which spring force is less than a differential pressure between the first and second chambers in normal operation.

In one variation, at least one wall includes a flexible membrane at the second end of the housing. In another variation, the at least one wall includes a side wall formed as an accordion-type wall which can compress and expand in height.

As an option, a tube can extend from the opening into the glass envelope to hinder the introduction of heat from the glass envelope to the second chamber.

In accordance with a second embodiment of the present invention, the moving/restraining arrangement includes a rod having one end in contact with an inner surface of the glass envelope and an opposite end which maintains the electrical contact member in electrical contact with at least one electrical power lead, and/or at least one the electrical contact, during normal operation of the safety lightbulb when the glass envelope is unbroken.

The safety arrangement further includes a spring in the base which functions to bias the electrical contact member with a spring force in a direction to move the electrical contact member out of electrical contact with at least the electrical power lead, and/or at least one the electrical contact, when the glass envelope is broken and the rod no longer applies a force on the electrical contact member, but which spring force is less than a force applied in an opposite direction by the rod.

There is also a stub tube that slidably extends through a wall of the base which separates the base and the glass envelope. The stub tube has a first end engaging the electrical contact member. The rod includes a first end in engagement with the inner surface of the glass envelope and a second end in engagement with the first end of the stub tube to move the stub tube in a direction into the base so as to maintain the electrical contact member in electrical contact with at least one electrical power lead, and/or at least one the electrical contact, during normal operation of the safety lightbulb when the glass envelope is unbroken.

In the second embodiment, there is also a second safety arrangement for preventing sliding movement of the stub tube into the base when the lightbulb is broken. The second safety arrangement includes a safety housing connected with the stub tube, at least one transverse rod slidably mounted in the safety housing and having an end extending out of the safety housing, and a biasing arrangement for biasing the at least one transverse rod in a direction out of the safety housing. At least one arrangement has a first engagement surface at an inner surface of the base and a second engagement surface at the inner surface of the base and which is positioned radially outwardly of the first engagement surface, the second engagement surface being positioned closer to the glass envelope than the first engagement surface. Accordingly, the end of the at least one transverse rod is engaged with the first engagement surface when the glass envelope is unbroken. However, movement of the stub tube in a direction toward the glass envelope when the glass envelope breaks and the rod falls away from the stub tube causes the safety housing to move in a direction toward the glass envelope such that the biasing arrangement moves the at least one transverse rod into engagement with the second engagement surface, thereby preventing return movement of the stub tube in a direction into the base.

The at least one arrangement includes at least one projection extending inwardly from an inner wall of the base, each projection including a stepped surface facing the glass envelope, and the at least one projection with the stepped surface forming the first and second engagement surfaces.

In accordance with the present invention, the lightbulb can be an incandescent lightbulb, or a fluorescent lightbulb.

The above and other objects, features and advantages of the invention will become readily apparent from the following detailed description thereof which is to be read in connection with the accompanying drawings.

BRIEF DESCRIPTION OF THE DRAWINGS

FIG. 17A is a cross-sectional view of an incandescent safety lightbulb according to a fourth modification of the first embodiment of the present invention in its operative state;

FIG. 17B is a cross-sectional view of the incandescent safety lightbulb of FIG. 17A after the glass has been shattered;

FIGS. 17C-17F show these components in more detail;

FIG. 21 is a side elevational view of the secondary safety assembly of the lightbulb of FIG. 19 in the operative state of the lightbulb; and FIG. 22 is a side elevational view of the secondary safety assembly of the lightbulb of FIG. 19 after the glass has been shattered.

DETAILED DESCRIPTION

Figure 1:
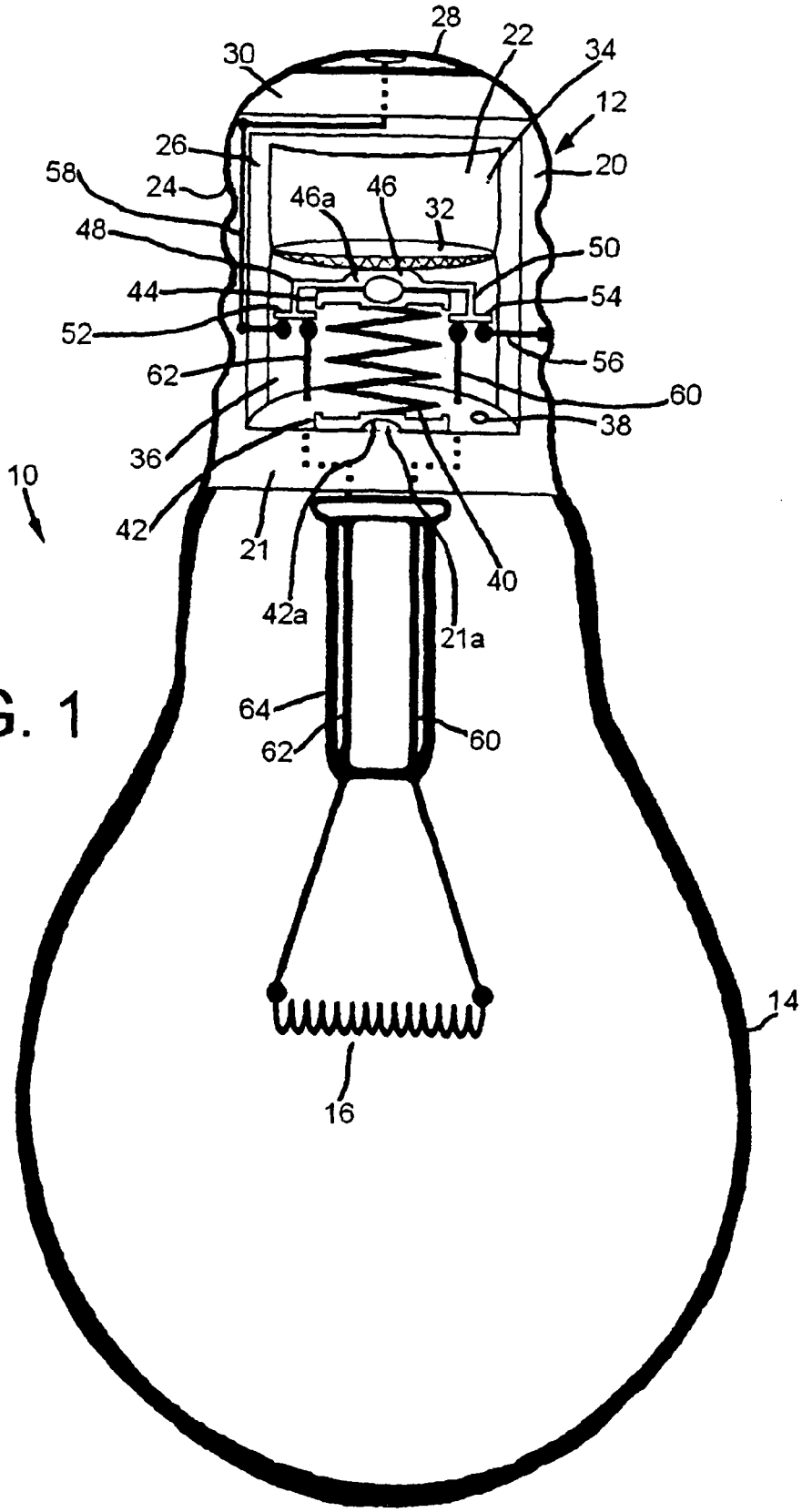
FIG. 1 is a cross-sectional view of an incandescent safety lightbulb according to a first embodiment of the present invention in its operative state.
Figure 2:
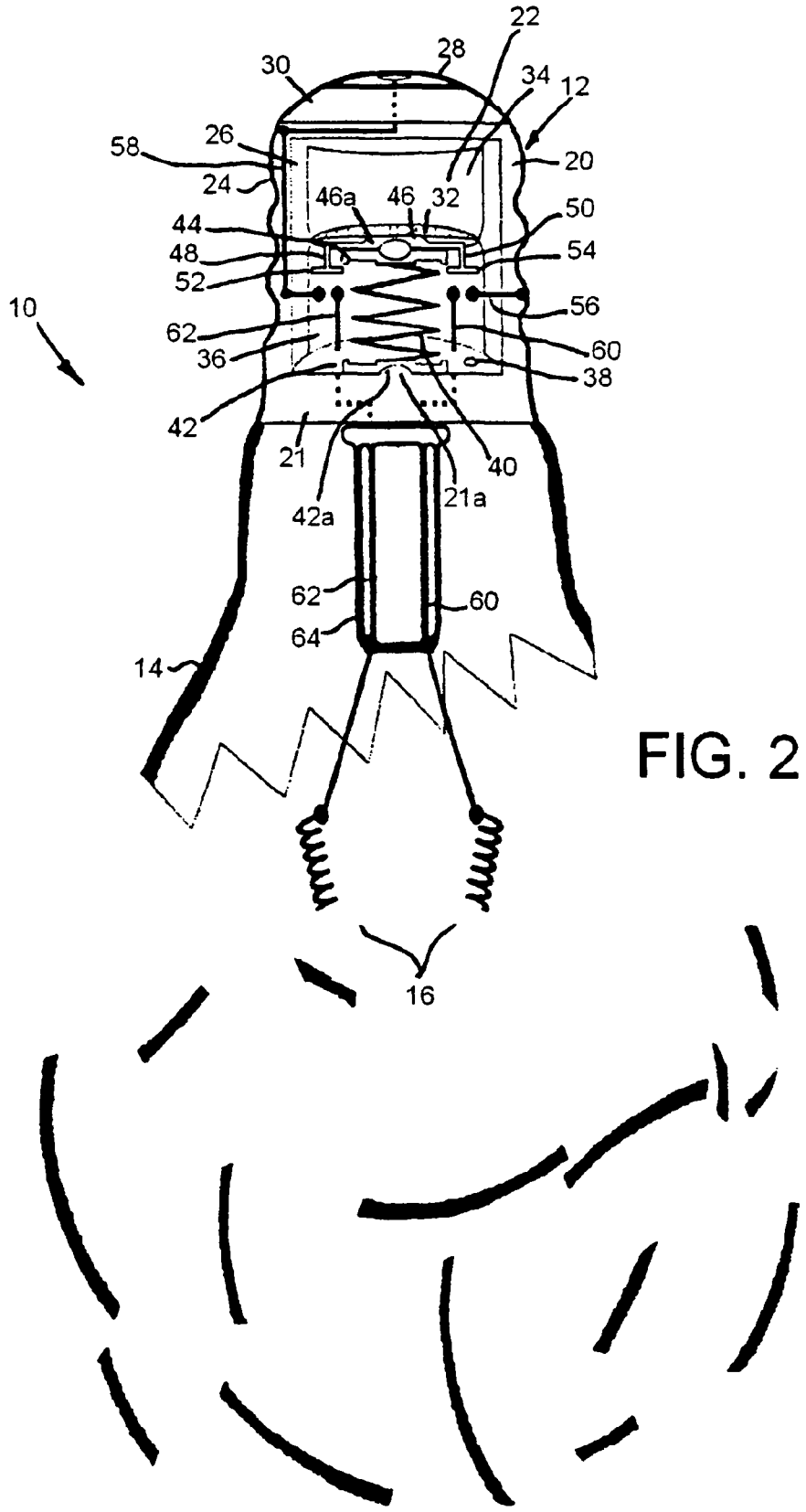
FIG. 2 is a cross-sectional view of the incandescent safety lightbulb of FIG. 1 after the glass has been shattered.
Figure 3:
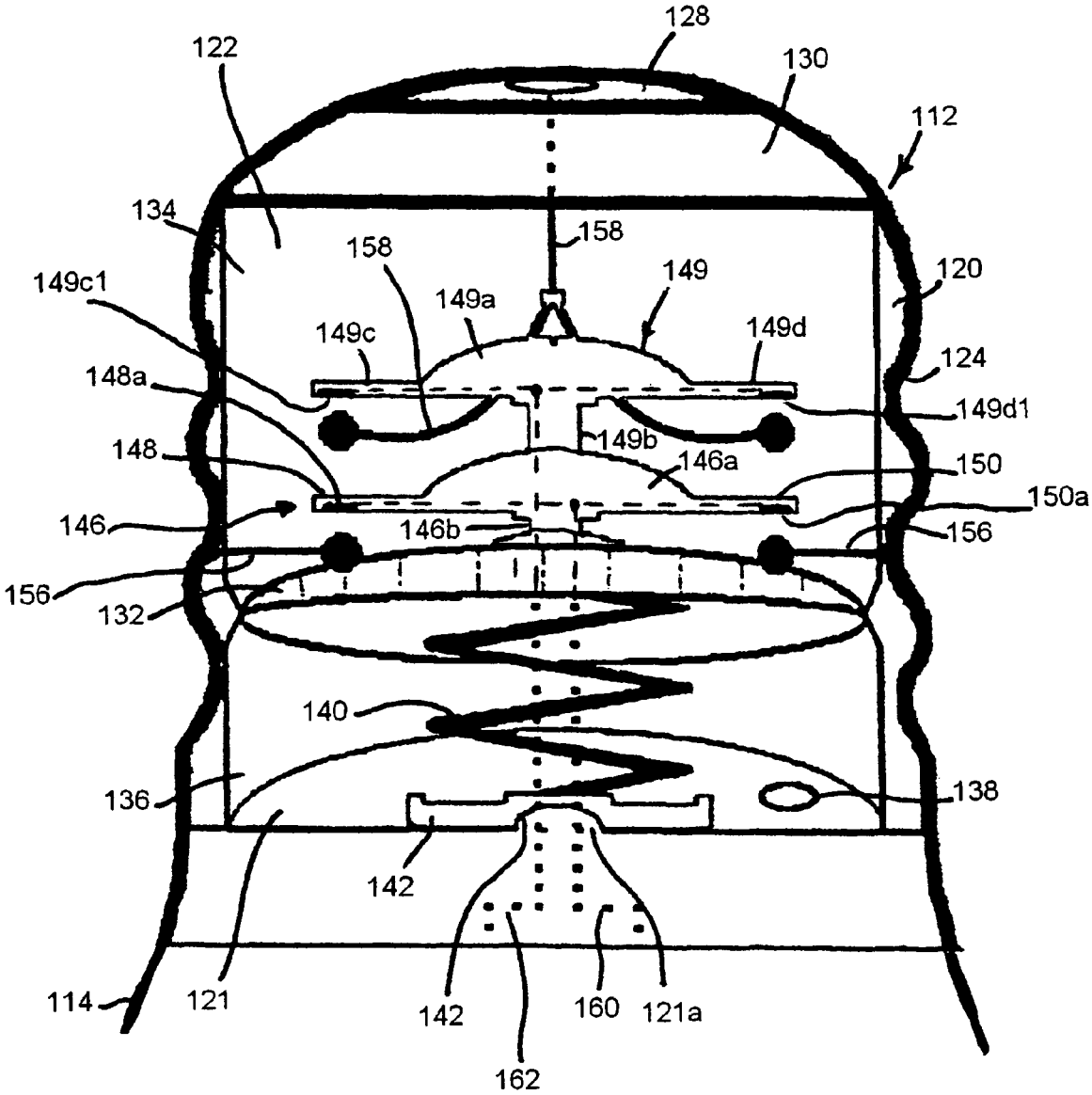
FIG. 3 is an enlarged cross-sectional view of the base of an incandescent safety lightbulb according to a modification of the first embodiment of the present invention after the glass has been shattered.
Figure 4:
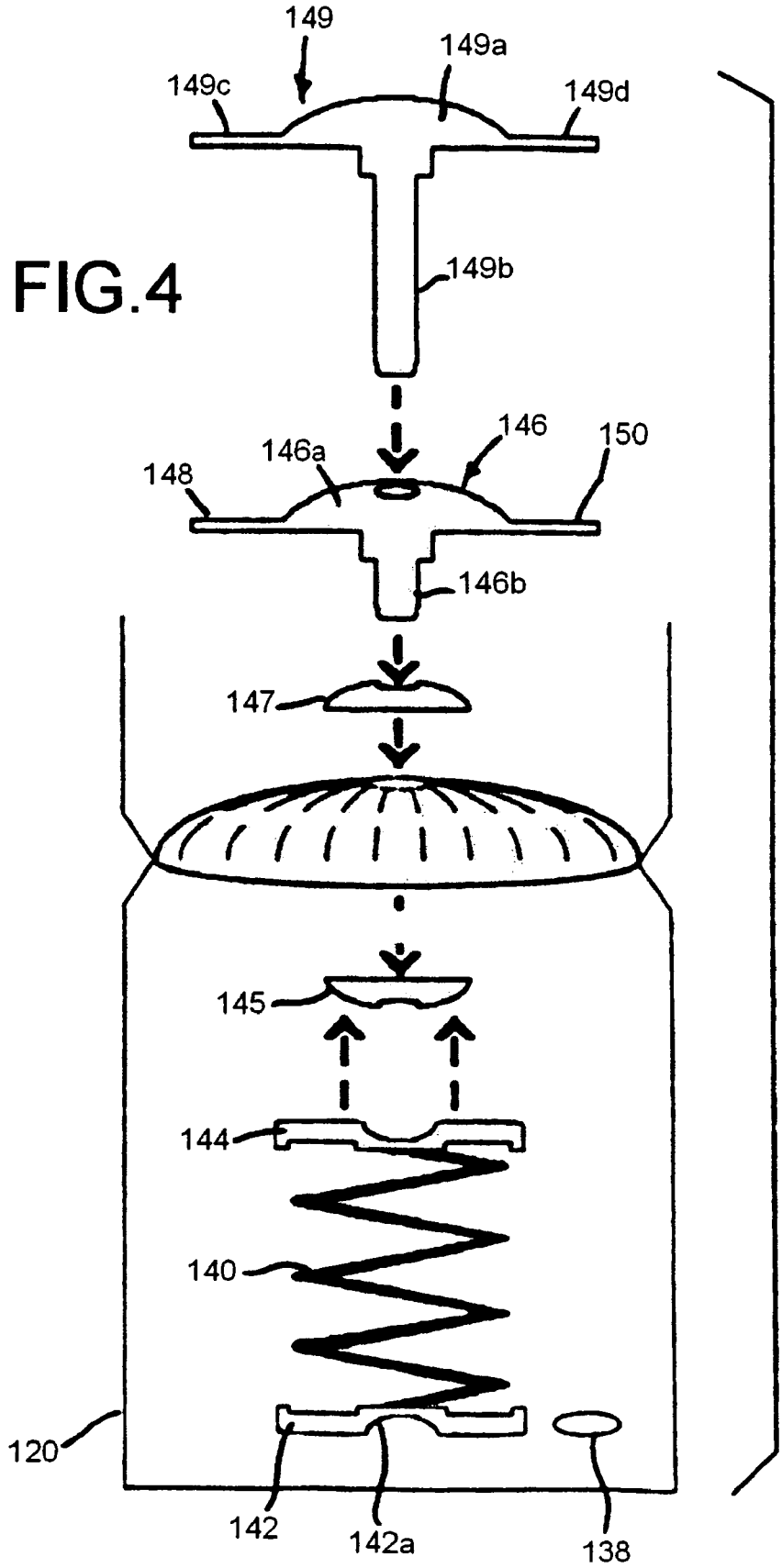
FIG. 4 is an exploded elevational view of the different safety parts in the base of the incandescent safety lightbulb of FIG. 3.
Figure 5:
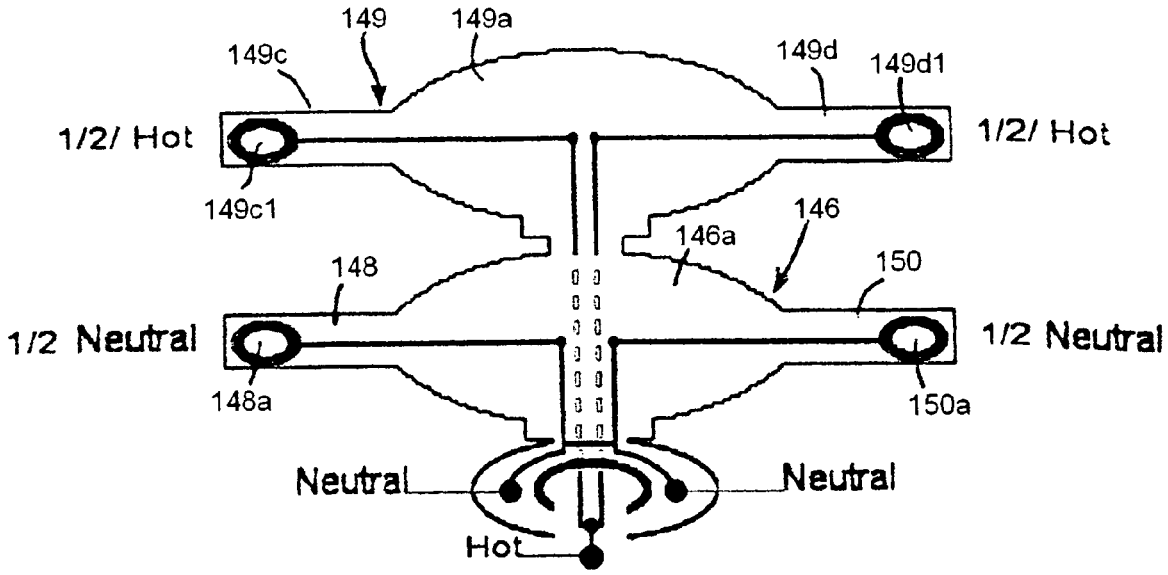
FIG. 5 is a schematic view showing the first and second T-shaped contact members and the wiring therefor.

Referring to the drawings in detail, and initially to FIGS. 1 and 2 thereof, an incandescent lightbulb 10 according to a first embodiment of the present invention includes a base 12 and an evacuated glass envelope 14 secured thereto, with a filament 16 contained in glass envelope 14 and adapted to be heated so as to emit light.

Base 12 includes a closed casing 20 having a hollow interior chamber 22. Casing 20 is preferably made of an electrically conductive material, such as an electrically conductive metal which constitutes the neutral or ground electrical contact, and preferably has threads 24 on the exterior surface for receipt in a threaded electrical socket (not shown). The inner surfaces of casing 20 are preferably insulated with an insulating layer 26. Further, base 12 includes an electrically conductive end cap 28 which constitutes the hot electrical contact, and which is connected to a non-threaded part of casing 20 through an insulating layer 30, so as to be electrically insulated from casing 20.

Hollow interior chamber 22 is divided by a flexible membrane 32, preferably of a plastic or light metal material, which divides chamber 22 into first and second chambers 34 and 36, respectively. In this regard, the periphery of membrane 32 is connected to the inner surface of casing 20. First chamber 34 is provided with air at a first pressure, which is preferably ambient atmosphere, while second chamber 36 is in fluid communication with the interior of glass envelope 14 through an opening 38 in a wall 21 of casing 20 so as to be effectively evacuated as well, and thereby, at a much reduced pressure in comparison to first chamber 34. As a result, flexible membrane 32 is biased toward wall 21 by the pressure differential between chambers 34 and 36.

A coil spring 40 is interposed between wall 21 and flexible membrane 32, but the force of coil spring 40 is not sufficient to overcome the force of the pressure differential between chambers 34 and 36. A first coil spring holder 42 is provided on wall 21 for holding or restraining a first end of coil spring 40, and includes a recess **42*a* which is centered on a projection 21*a* on wall 21 and which faces away from coil spring 40. In like manner, a second coil spring holder 44 is provided for holding or restraining the opposite, second end of coil spring 40, and is fixed by any suitable means, such as adhesive, welding or the like on a main body 46*a* of an electrical contact member 46. Electrical contact member 46, in turn, fixed by any suitable means such as adhesive, welding or the like to flexible membrane 32. In this regard, coil spring 40** is restrained to only move axially.

Electrical contact member 46 includes two electrical contact arms 48 and 50 extending outwardly from main body **46*a* and within second chamber 36, with electrical contact plates 52 and 54 at the ends of contact arms 48 and 50, respectively. Insulated neutral wiring 56 extends from the outer surface of casing 20 at threads 24 thereof into the interior of second chamber 36 and has a contact end which terminates immediately adjacent electrical contact plate 54, while insulated hot wiring 58 extends from electrically conductive end cap 28, through casing 20 into the interior of second chamber 36 and has a contact end which terminates immediately adjacent electrical contact plate 52**.

In this manner, when the pressure in first chamber 34 is greater than that in second chamber 36, flexible membrane 32 is biased toward wall 21 so as to force electrical contact member 46 in the same direction. As a result, electrical contact plates 52 and 54 are moved into contact with insulated hot wiring 58 and insulated neutral wiring 56 which extend into second chamber 36, thereby closing the electrical circuit, whereby current flows therethrough.

A first neutral filament wire 60 is connected to one end of filament 16 and extends through wall 21 of casing 20 into second chamber 36, with the opposite end thereof having a contact positioned immediately adjacent to the free end of insulated neutral wiring 56 and immediately adjacent electrical contact plate 54. In like manner, a second hot filament wire 62 is connected to the opposite end of filament 16 and extends through wall 21 of casing 20 into second chamber 36, with the opposite end thereof positioned immediately adjacent to the free end of insulated hot contact plate 52. Thus, when the aforementioned electrical circuit is closed, current flows through filament wire 16 to heat the same, thereby causing filament wire 16 to emit light in normal operation. A guide cage 64 is provided in evacuated glass envelope 14 to guide first neutral filament wire 60 and second hot filament wire 62.

When evacuated glass envelope 14 breaks, as shown in FIG. 2, with filament wire 62 broken as shown, or unbroken (not shown), second chamber 36 is now connected with ambient atmosphere through opening 38. At this time, the pressures in chambers 34 and 36 are equalized, so that flexible membrane 32 is no longer restrained, that is, membrane 32 is no longer biased in a direction toward wall 21 by this pressure differential, and therefore resumes its original, unbiased configuration due to its elastic memory. The moving of flexible membrane 32 is aided by coil spring 40. As a result, coil spring 40 further biases electrical contact member 46 and flexible membrane 32 in a direction toward electrically conductive end cap 28. This results in electrical contact plates 52 and 54 moving away from the free ends of insulated neutral wiring 56, insulated hot wiring 58, first neutral filament wire 60 and second hot filament wire 62. This causes the electrical circuit to open within base 12, so that no current can flow through first neutral filament wire 60, second hot filament wire 62 or filament 16, whereby no electric shock can be imparted to a person that accidentally touches filament 16 or wires 60 or 62.

Referring now to FIGS. 3-7, an incandescent lightbulb 110 according to a modification of the first embodiment of the present invention will now be described in which elements corresponding to those of FIGS. 1 and 2 are identified by the same reference numerals, augmented by 100. Incandescent lightbulb 110 differs from incandescent lightbulb 10 by providing the electrical contacts above flexible membrane 132.

Incandescent lightbulb 110 includes a base 112 and an evacuated glass envelope 114 secured thereto, with a filament 116 contained in glass envelope 114 and adapted to be heated so as to emit light.

Base 112 includes a closed casing 120 having a hollow interior chamber 122. Casing 120 is preferably made of an electrically conductive material, such as an electrically conductive metal which constitutes the neutral or ground electrical contact, and preferably has threads 124 on the exterior surface for receipt in a threaded electrical socket (not shown). Further, base 112 includes an electrically conductive end cap 128 which constitutes the hot electrical contact, and which is connected to a non-threaded part of casing 120 through an insulating layer 130, so as to be electrically insulated from casing 120.

Hollow interior chamber 122 is divided by a flexible membrane 132, preferably of a plastic or light metal material, which divides chamber 122 into a first chamber 134 and a second chamber 136. In this regard, the periphery of membrane 132 is connected to the inner surface of casing 120. First chamber 134 is provided with air at a first pressure, which is preferably ambient atmosphere, while second chamber 136 is in fluid communication with the interior of glass envelope 114 through an opening 138 in a wall 121 of casing 120 so as to be effectively evacuated as well, and thereby, at a much reduced pressure in comparison to first chamber 134. As a result, flexible membrane 132 is biased toward wall 121 by the pressure differential.

A coil spring 140 is interposed between wall 121 and flexible membrane 132, but the force of coil spring 140 is not sufficient to overcome the force of the pressure differential between chambers 134 and 136. A first coil spring holder 142 is provided on wall 121 for holding or restraining a first end of coil spring 140, and includes a recess 142*a* which is centered on a projection 121*a* on wall 121 and which faces away from coil spring 140. In like manner, a second coil spring holder 144 is provided for holding or restraining the opposite, second end of coil spring 140, and is fixed by any suitable means, such as adhesive, welding or the like to a first clamp member 145, which in turn, is centrally in contact with one side of flexible membrane 132. In this regard, coil spring 140 is restrained to only move axially. A second clamp member 147 engages centrally on the opposite side of flexible membrane 132.

A first T-shaped contact member 146 of a non-electrically conducting material, includes a main body 146*a* with a central hollow leg 146*b* extending axially therefrom and two radially extending arms 148 and 150 extending outwardly from main body 146*a* and within first chamber 134. Central hollow leg 146*b* extends within central openings of clamp members 145 and 147 and within a central opening of flexible membrane 132, and is secured to clamp members 145 and 147 by any suitable means, such as adhesive, welding or the like, whereby membrane 132 is fixedly held between clamp members 145 and 147.

A second T-shaped contact member 149 of a non-electrically conducting material, includes a main body 149*a* with a central leg 149*b* extending axially therefrom and two radially extending arms 149*c* and 149*d* extending outwardly from main body 149*b* and within first chamber 134. Central leg 149*a* extends within an opening 146*c* of main body 146*a* and into central leg 146*a*, and is secured therein by any suitable means, such as adhesive, welding or the like. Of course, it will be appreciated that first and second T-shaped contact members 146 and 149 can be made as a unitary, one piece assembly.

In this manner, flexible membrane 132, clamp members 145 and 147 and T-shaped contact members 146 and 149 are connected together as a unit. As a result, if flexible membrane 132 moves away from coil spring 140, clamp members 145 and 147 and T-shaped contact members 146 and 149 move therewith.

Insulated neutral wiring 156 extends from the outer surface of casing 120 at threads 124 thereof into the interior of first chamber 134 and has contact ends which terminate immediately adjacent contact arms 148 and 150, while insulated hot wiring 158 extends from electrically conductive end cap 128, through insulating layer 130 into the interior of first chamber 134 and has contact ends which terminate immediately adjacent contact arms 149*c* and 149*d*.

A first neutral filament wire 160 is connected to one end of filament 116 in glass envelope 114, and extends through wall 121, into second chamber 136 within the confines of spring 140, through a central opening in membrane 132 and into first T-shaped contact member 146 where it branches out through radially extending contact arms 148 and 150, and the branched out wires are electrically connected to contact plates 148*a* and 150*a* exposed at the underside of radially extending contact arms 148 and 150 in opposing relation to the free ends of neutral wiring 156.

In like manner, a second hot filament wire 162 is connected to the opposite end of the filament and extends through wall 121, into second chamber 136 within the confines of spring 140, through a central opening in membrane 132, through first T-shaped contact member 146 and then into second T-shaped contact member 149 where it branches out through radially extending contact arms 149*c* and 149*d*, and the branched out wires are electrically connected to electrical contact plates 149*c*1 and 149*d*1 exposed at the underside of radially extending contact arms 149*c* and 149*d* in opposing relation to the free ends of hot wiring 158. This is shown schematically in FIG. 5 from the underside of the T-shaped contact members 146 and 149.

Figure 6:
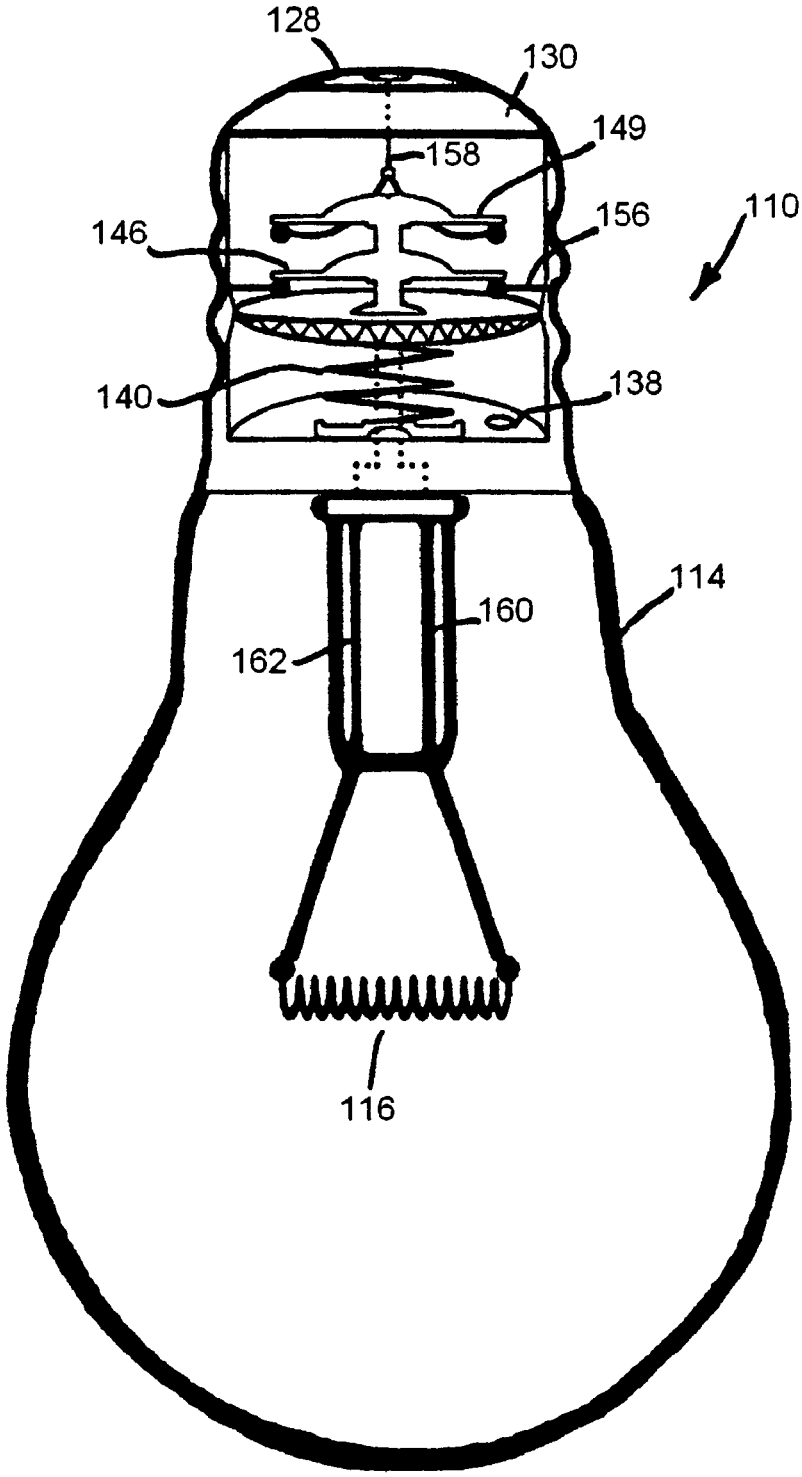
FIG. 6 is a cross-sectional view of the entire incandescent safety lightbulb according to FIG. 3 in its operative state.

In this manner, as shown in FIG. 6, when the pressure in first chamber 134 is greater than that in second chamber 136, flexible membrane 132 is biased toward wall 121 so as to force contact members 146 and 149 in the same direction. As a result, electrical contact plates 149*c*1 and 149*d*1 of contact arms 149*c* and 149*d* are moved into electrical contact with insulated hot wiring 158 and electrical contact plates 148*a* and 150*a* of contact arms 148 and 150 are moved into electrical contact with insulated neutral wiring 156, thereby closing the electrical circuit. Thus, when the aforementioned electrical circuit is closed, current flows through filament 116 to heat the same, thereby causing filament 116 to emit light in normal operation.

Figure 7:
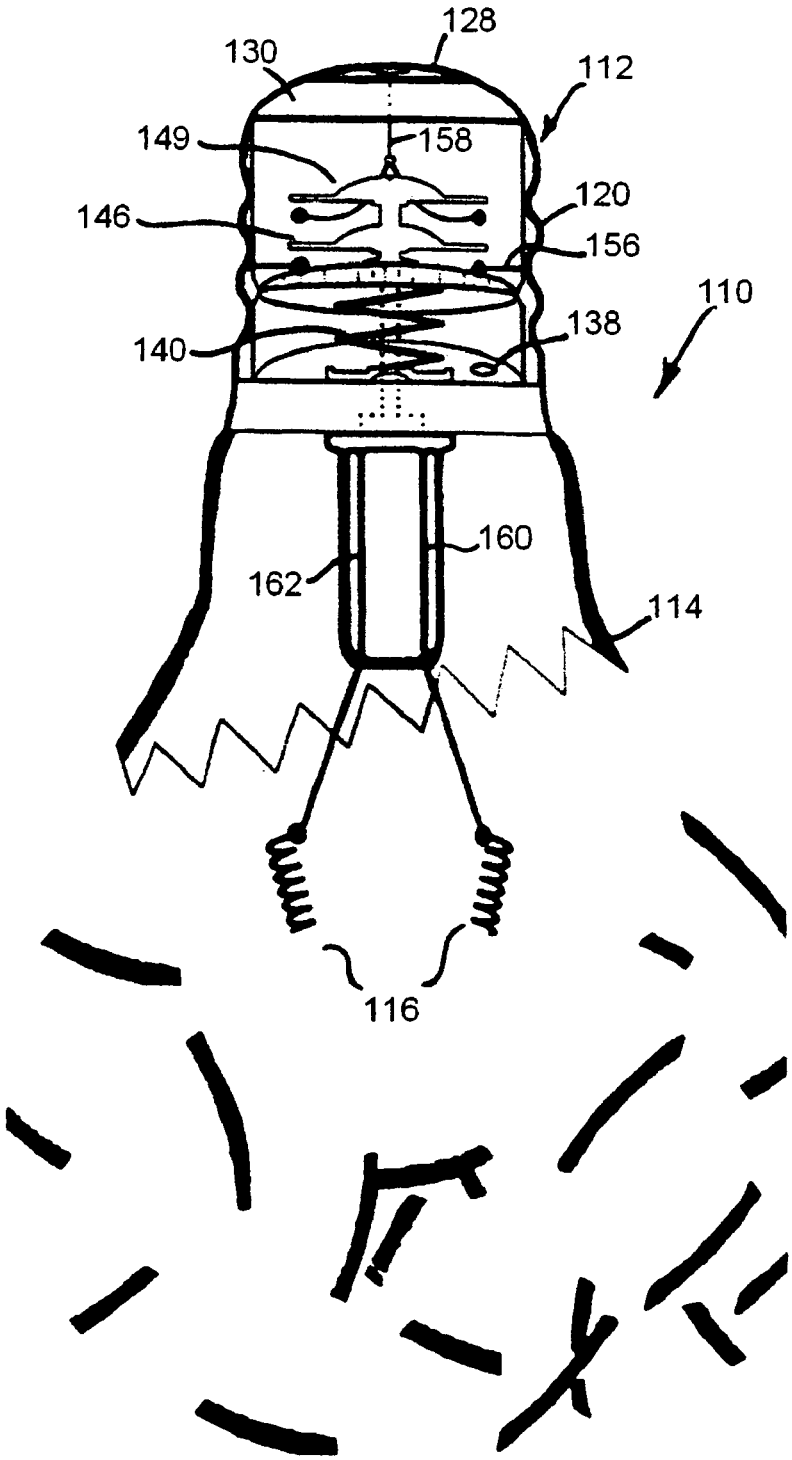
FIG. 7 is a cross-sectional view of the incandescent safety lightbulb of FIG. 6 after the glass has been shattered.

When evacuated glass envelope 114 breaks, as shown in FIG. 7, second chamber 136 is now connected with ambient atmosphere through opening 138. At this time, the pressures in chambers 134 and 136 are equalized, so that flexible membrane 132 is no longer restrained, that is, membrane 132 is no longer biased by this pressure differential, and therefore resumes its original, unbiased configuration due to its elastic memory. The moving of flexible membrane 132 is aided by coil spring 140. As a result, coil spring 140 further biases flexible membrane 132 in a direction toward electrically conductive end cap 128. This results in electrical contact plates 148*a* and 150*a* of contact arms 148 and 150 moving away from the free ends of insulated neutral wiring 156, and electrical contact plates 149*c*1 and 149*d*1 of contact arms 149*c* and 149*d* moving away from the free ends of insulated hot wiring 158. This causes the electrical circuit to open within base 112, so that no current can flow through first neutral filament wire 160, second hot filament wire 162 or the filament, whereby no electric shock can be imparted to a person that accidentally touches the filament.

Referring now to FIGS. 8-12, an incandescent lightbulb 210 according to a second modification of the first embodiment of the present invention will now be described in which elements corresponding to those of FIGS. 1 and 2 are identified by the same reference numerals, augmented by 200. Incandescent lightbulb 110 differs from incandescent lightbulb 10 by eliminating the flexible membrane.

Incandescent lightbulb 210 includes a base 212 and an evacuated glass envelope 214 secured thereto, with a filament 216 contained in glass envelope 214 and adapted to be heated so as to emit light.

Base 212 includes a closed casing 220 having a hollow interior chamber 222. Casing 220 is preferably made of an electrically conductive material, such as an electrically conductive metal which constitutes the neutral or ground electrical contact, and preferably has threads 224 on the exterior surface for receipt in a threaded electrical socket (not shown). The inner surfaces of casing 220 are preferably insulated with an insulating layer 226. Further, base 212 includes an electrically conductive end cap 228 which constitutes the hot electrical contact, and which is connected to a non-threaded part of casing 220 through an insulating layer 230, so as to be electrically insulated from casing 220.

Hollow interior chamber 222 is divided by a flexible accordion-type housing 232, which has its lower end fixed on a lower wall 221 of casing 220. As a result, accordion-type housing 232 divides chamber 222 into a first chamber 234 within casing 220 and outside of accordion-type housing 232, and a second chamber 236 within accordion-type housing 232. First chamber 234 is provided with air at a first pressure, which is preferably ambient atmosphere, while second chamber 236 is in fluid communication with the interior of glass envelope 214 through an opening 238 in wall 221 of casing 220 so as to be effectively evacuated as well, and thereby, at a much reduced pressure in comparison to first chamber 234. As a result, accordion-type housing 232 is compressed and biased toward wall 221 by the pressure differential between chambers 234 and 236.

A coil spring 240 is provided within accordion-type housing 232, but the force of coil spring 240 is not sufficient to overcome the force of the pressure differential between chambers 234 and 236. A first coil spring holder 242 is provided on wall 221 for holding or restraining a first end of coil spring 240, and includes a recess 242*a* which is centered on a projection 221*a* on wall 221 and which faces away from coil spring 240. In like manner, a second coil spring holder 244 is provided for holding or restraining the opposite, second end of coil spring 240, and is fixed by any suitable means, such as adhesive, welding or the like on a main body 246*a* of an electrical contact member 246. In this regard, coil spring 240 is restrained to only move axially. The upper end of accordion-type housing 232 is fixed to the underside of main body 246*a* of electrical contact member 246 in surrounding relation to second coil spring holder 244 and/or to second coil spring holder 244, by any suitable means such as adhesive, welding or the like.

Electrical contact member 246 includes two electrical contact arms 248 and 250 extending outwardly from main body 246*a* and within first chamber 234, with electrical contact plates 252 and 254 at the ends of contact arms 248 and 250, respectively. Insulated neutral wiring 256 extends from the outer surface of casing 220 at threads 224 thereof into the interior of first chamber 234 and has a contact end which terminates immediately adjacent electrical contact plate 254, while insulated hot wiring 258 extends from electrically conductive end cap 228, through casing 220 into the interior of first chamber 234 and has a contact end which terminates immediately adjacent electrical contact plate 252.

Figure 8:
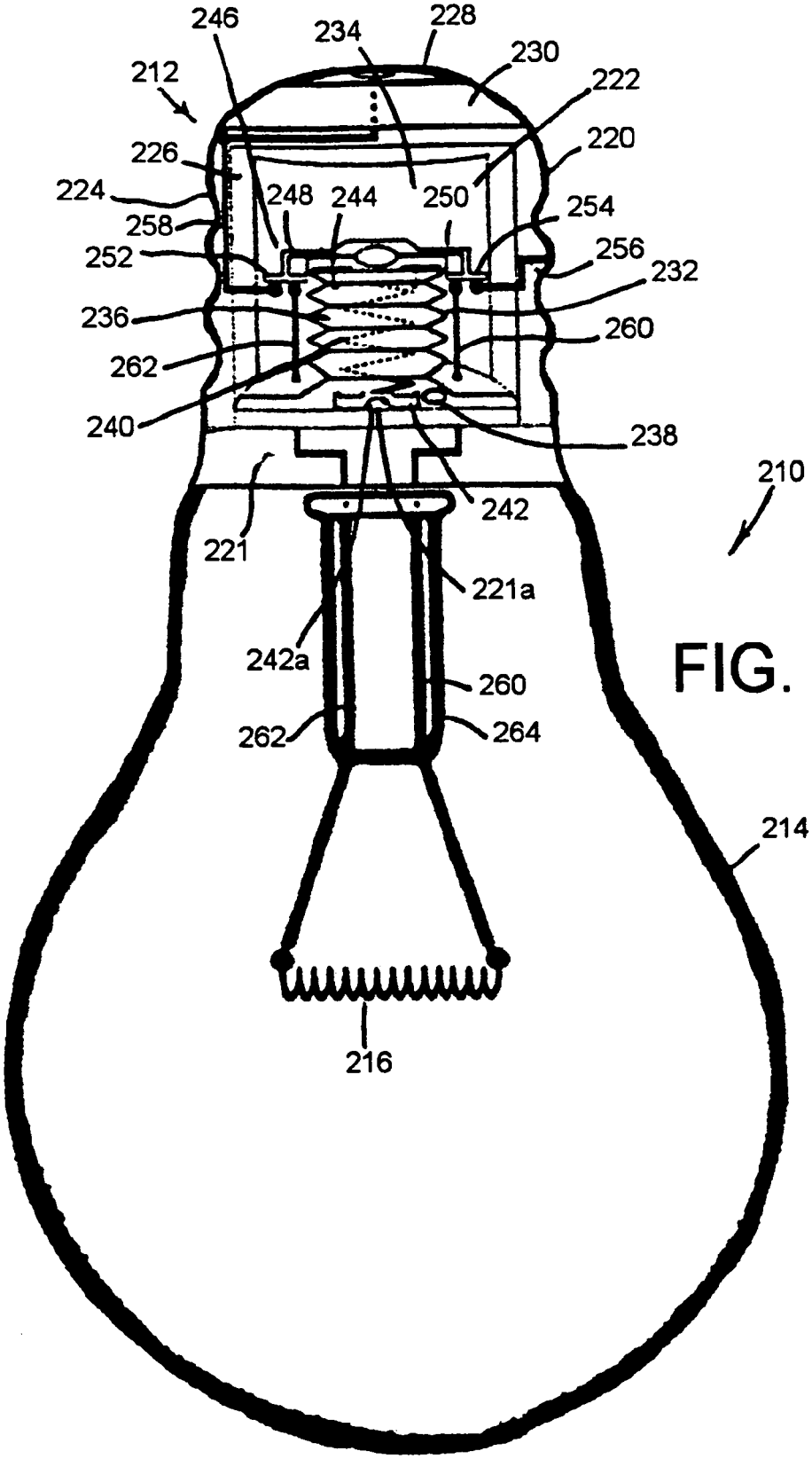
FIG. 8 is a cross-sectional view of an incandescent safety lightbulb according to a second modification of the first embodiment of the present invention in its operative state.
Figure 9:
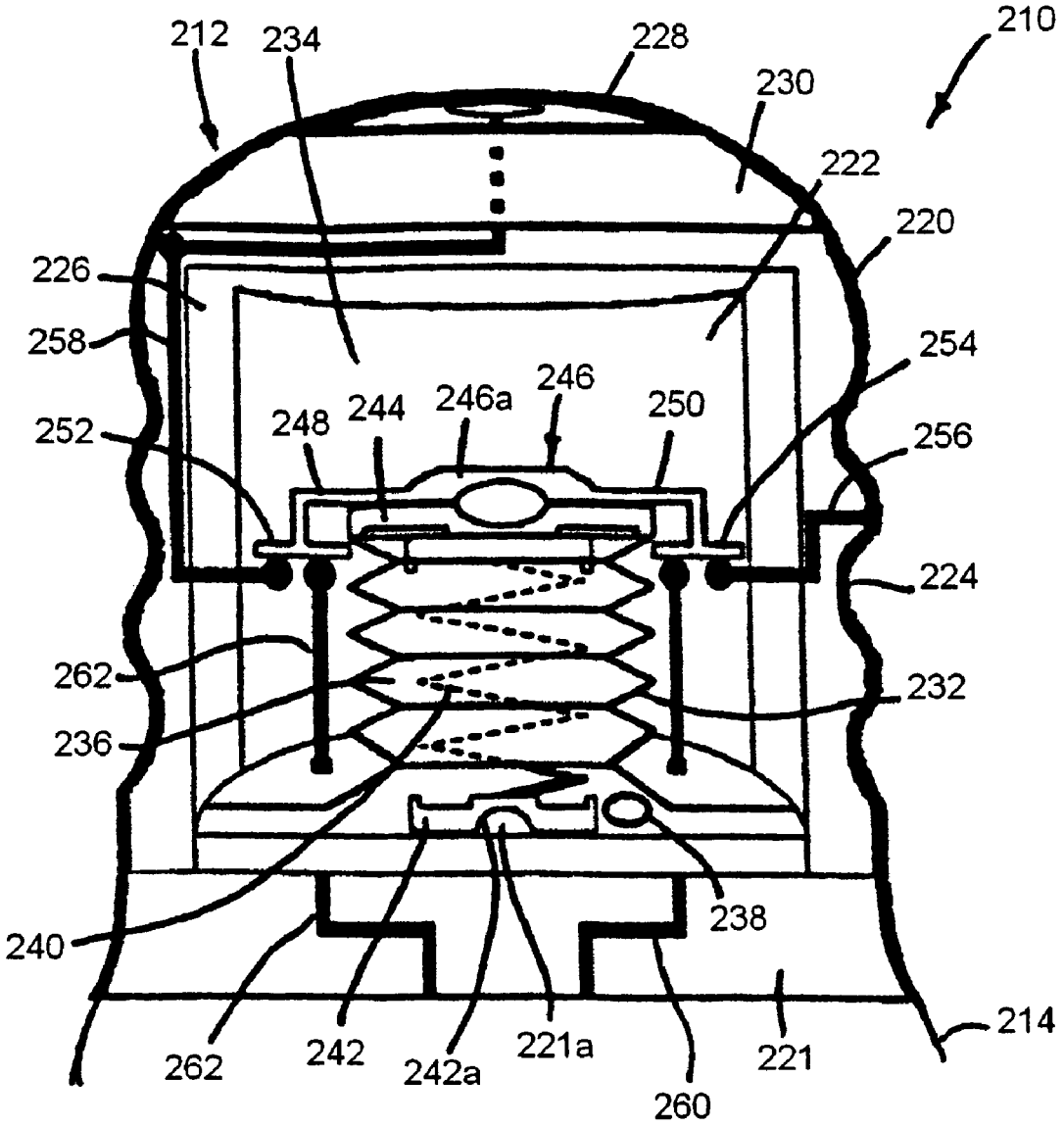
FIG. 9 is an enlarged cross-sectional view of the base of the incandescent safety lightbulb of FIG. 8.

In this manner, as shown in FIGS. 8 and 9, when the pressure in first chamber 234 is greater than that in second chamber 236, accordion-type housing 232 is biased toward wall 221 so as to force electrical contact member 246 in the same direction. As a result, electrical contact plates 252 and 254 are moved into contact with insulated hot wiring 258 and insulated neutral wiring 256 which extend into second chamber 236, thereby closing the electrical circuit, whereby current flows therethrough.

A first neutral filament wire 260 is connected to one end of filament 216 and extends through wall 221 of casing 220 into first chamber 234, with the opposite end thereof having a contact positioned immediately adjacent to the free end of insulated neutral wiring 256 and immediately adjacent electrical contact plate 254. In like manner, a second hot filament wire 262 is connected to the opposite end of filament 216 and extends through wall 221 of casing 220 into first chamber 234, with the opposite end thereof positioned immediately adjacent to the free end of insulated hot contact plate 252. Thus, when the aforementioned electrical circuit is closed, current flows through filament wire 216 to heat the same, thereby causing filament wire 216 to emit light in normal operation. A guide cage 264 is provided in evacuated glass envelope 214 to guide first neutral filament wire 260 and second hot filament wire 262.

Figure 10:
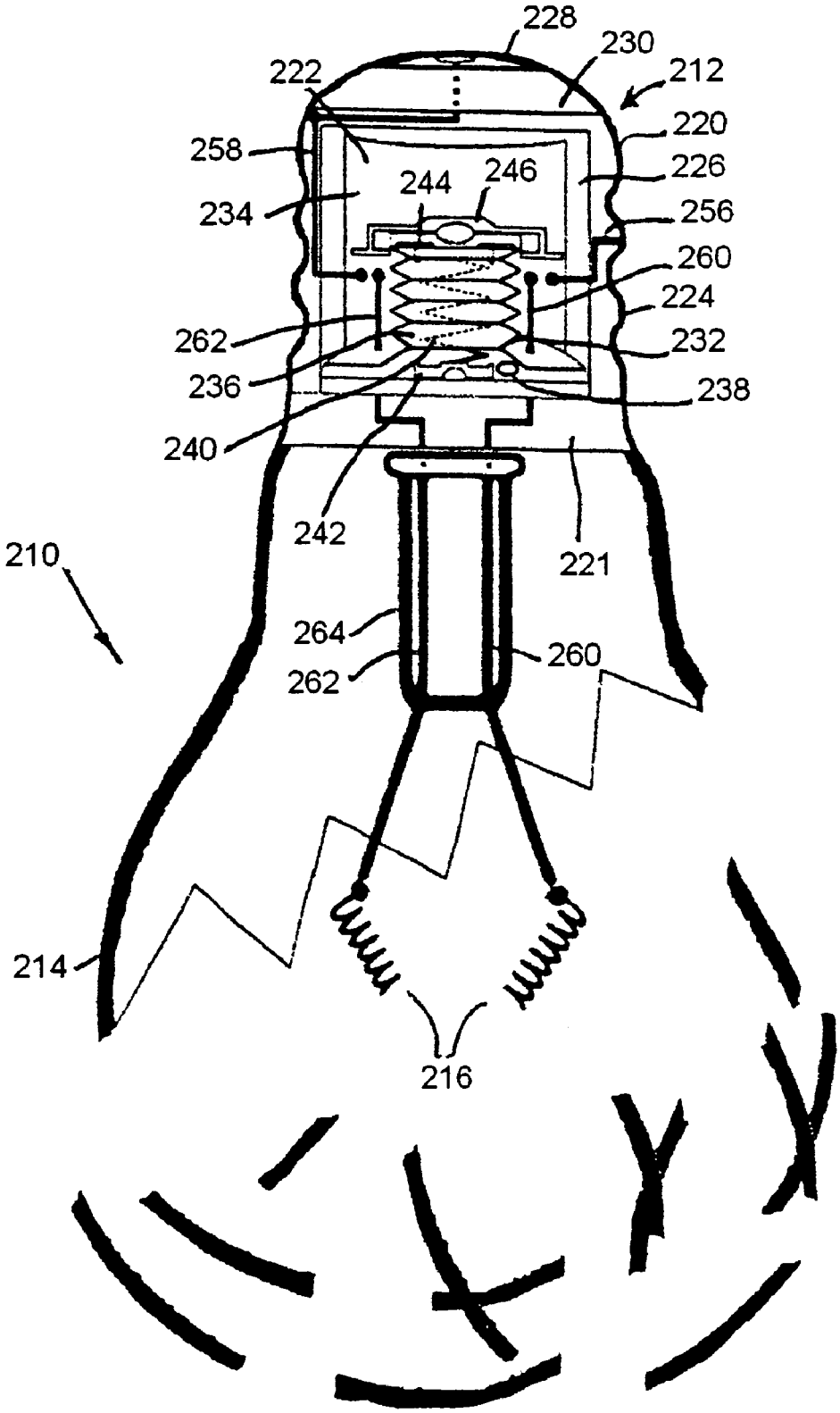
FIG. 10 is a cross-sectional view of the incandescent safety lightbulb of FIG. 8 after the glass has been shattered.
Figure 11:
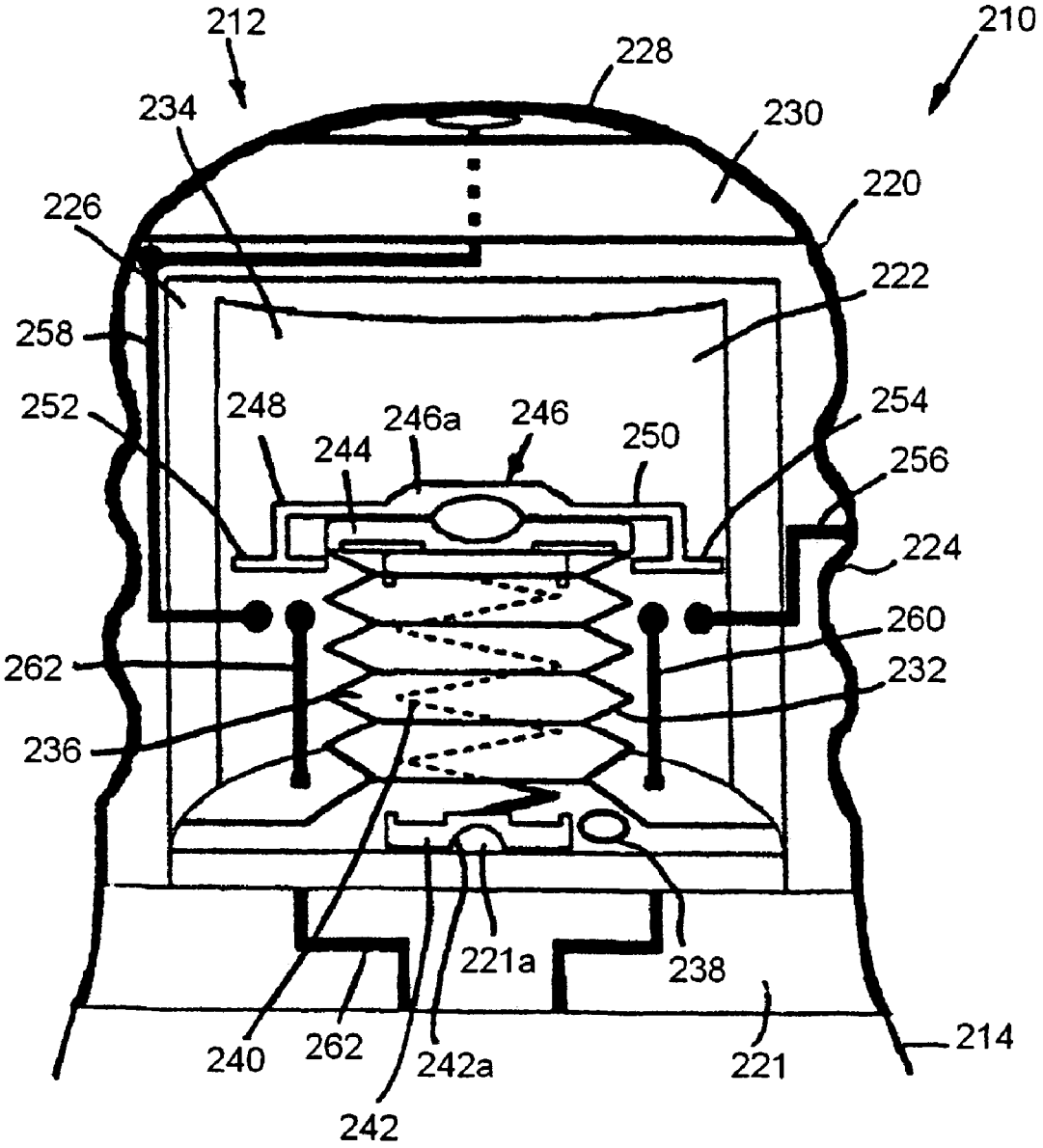
FIG. 11 is an enlarged cross-sectional view of the base of the incandescent safety lightbulb of FIG. 10.
Figure 12:
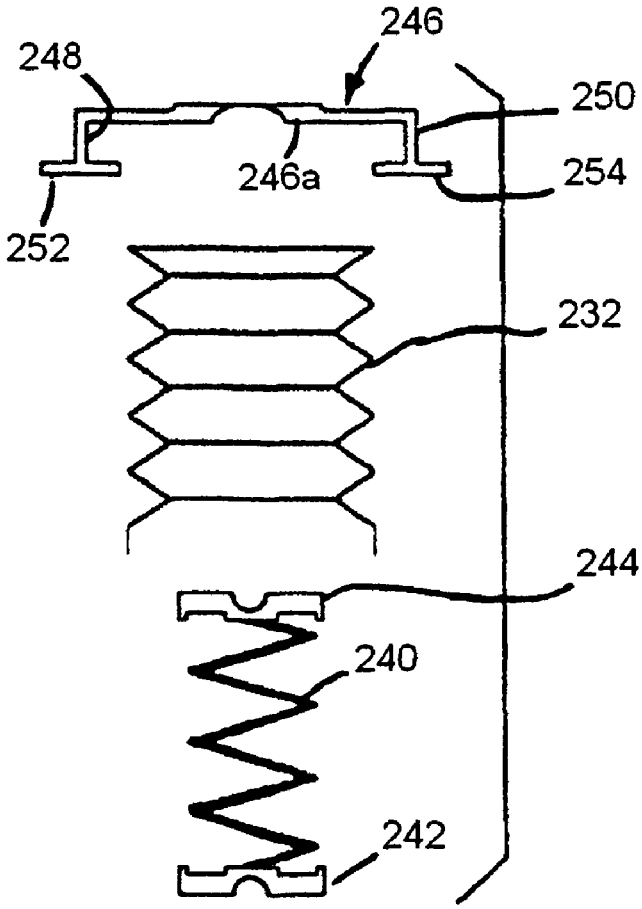
FIG. 12 is an exploded elevational view of the different safety parts in the base of the incandescent safety lightbulb of FIG. 8.

When evacuated glass envelope 214 breaks, as shown in FIGS. 10 and 11, with filament wire 262 broken as shown, or unbroken (not shown), second chamber 236 is now connected with ambient atmosphere through opening 238. At this time, the pressures in chambers 234 and 236 are equalized, so that flexible accordion-type housing 232 is no longer restrained, that is, flexible accordion-type housing 232 is no longer compressed and biased in a direction toward wall 221 by this pressure differential, and therefore resumes its original, unbiased configuration due to its elastic memory. The moving of flexible accordion-type housing 232 is aided by coil spring 240. As a result, coil spring 240 further biases electrical contact member 246 and flexible accordion-type housing 232 in a direction toward electrically conductive end cap 228. This results in electrical contact plates 252 and 254 moving away from the free ends of insulated neutral wiring 256, insulated hot wiring 258, first neutral filament wire 260 and second hot filament wire 262. This causes the electrical circuit to open within base 212, so that no current can flow through first neutral filament wire 260, second hot filament wire 262 or filament 216, whereby no electric shock can be imparted to a person that accidentally touches filament 216 or wires 260 or 262.

Referring now to FIGS. 13-17, an incandescent lightbulb 310 according to a third modification of the first embodiment of the present invention will now be described in which elements corresponding to those of FIGS. 1 and 2 are identified by the same reference numerals, augmented by 300. Incandescent lightbulb 310 is similar to incandescent lightbulb 210, but differs therefrom by eliminating flexible accordion-type housing 232.

Incandescent lightbulb 310 includes a base 312 and an evacuated glass envelope 314 secured thereto, with a filament 316 contained in glass envelope 314 and adapted to be heated so as to emit light.

Base 312 includes a closed casing 320 having a hollow interior chamber 322. Casing 320 is preferably made of an electrically conductive material, such as an electrically conductive metal which constitutes the neutral or ground electrical contact, and preferably has threads 324 on the exterior surface for receipt in a threaded electrical socket (not shown). The inner surfaces of casing 320 are preferably insulated with an insulating layer 326. Further, base 312 includes an electrically conductive end cap 328 which constitutes the hot electrical contact, and which is connected to a non-threaded part of casing 320 through an insulating layer 330, so as to be electrically insulated from casing 320.

Hollow interior chamber 322 is divided by a non-collapsible housing 331, which has its lower end fixed on a lower wall 321 of casing 320. Housing is closed at its upper end by a flexible membrane 332. As a result, housing 331 divides chamber 322 into a first chamber 334 within casing 320 and outside of housing 332, and a second chamber 336 within housing 332. First chamber 334 is provided with air at a first pressure, which is preferably ambient atmosphere, while second chamber 336 is in fluid communication with the interior of glass envelope 314 through an opening 338 in wall 321 of casing 320 so as to be effectively evacuated as well, and thereby, at a much reduced pressure in comparison to first chamber 334. As a result, flexible membrane 332 is compressed and biased toward wall 321 by the pressure differential between chambers 334 and 336.

A coil spring 340 is provided within housing 332, but the force of coil spring 340 is not sufficient to overcome the force of the pressure differential between chambers 334 and 336. A first coil spring holder 342 is provided on wall 321 for holding or restraining a first end of coil spring 340, and includes a recess 342*a* which is centered on the opening 328 in wall 321 and which faces away from coil spring 340. In like manner, a second coil spring holder 344 is provided for holding or restraining the opposite, second end of coil spring 340, and is fixed by any suitable means, such as adhesive, welding or the like to the underside of flexible membrane 332. In this regard, coil spring 340 is restrained to only move axially. The upper end of flexible membrane 332 is fixed to the underside of a main body 3246*a* of an electrical contact member 346 by any suitable means such as adhesive, welding or the like.

Electrical contact member 346 includes two electrical contact arms 348 and 350 extending outwardly from main body 346*a* and within first chamber 334, with electrical contact plates 352 and 354 at the ends of contact arms 348 and 350, respectively. Insulated neutral wiring 356 extends from the outer surface of casing 320 at threads 324 thereof into the interior of first chamber 334 and has a contact end which terminates immediately adjacent electrical contact plate 354, while insulated hot wiring 358 extends from electrically conductive end cap 328, through casing 320 into the interior of first chamber 334 and has a contact end which terminates immediately adjacent electrical contact plate 352.

Figure 13:
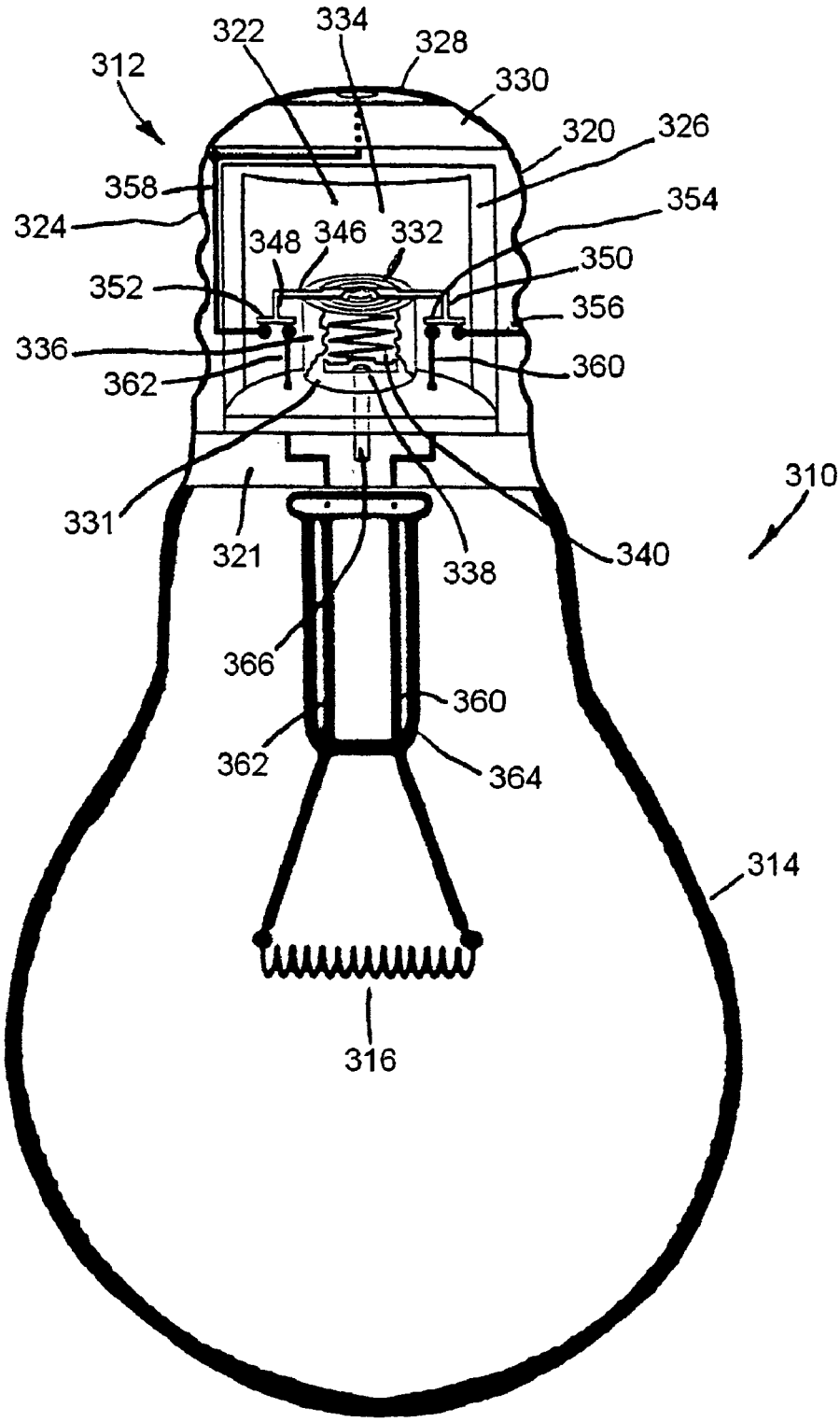
FIG. 13 is a cross-sectional view of an incandescent safety lightbulb according to a third modification of the first embodiment of the present invention in its operative state.
Figure 14:
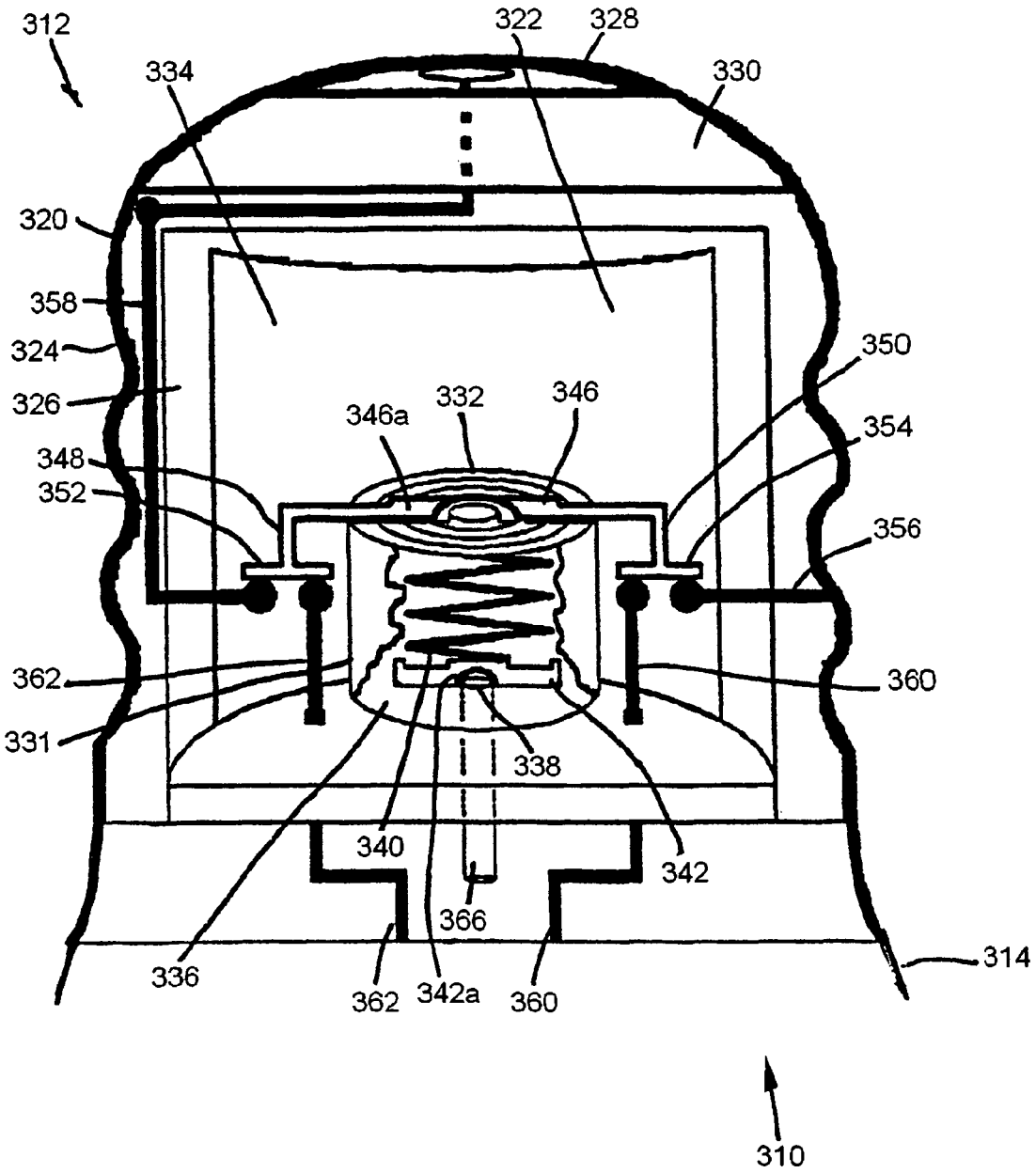
FIG. 14 is an enlarged cross-sectional view of the base of the incandescent safety lightbulb of FIG. 13.

In this manner, as shown in FIGS. 13 and 14, when the pressure in first chamber 334 is greater than that in second chamber 336, flexible membrane 332 is biased toward wall 321 so as to force electrical contact member 346 in the same direction. As a result, electrical contact plates 352 and 354 are moved into contact with insulated hot wiring 358 and insulated neutral wiring 356 which extend into second chamber 336, thereby closing the electrical circuit, whereby current flows therethrough.

A first neutral filament wire 360 is connected to one end of filament 316 and extends through wall 321 of casing 320 into first chamber 334, with the opposite end thereof having a contact positioned immediately adjacent to the free end of insulated neutral wiring 356 and immediately adjacent electrical contact plate 354. In like manner, a second hot filament wire 362 is connected to the opposite end of filament 316 and extends through wall 321 of casing 320 into first chamber 334, with the opposite end thereof positioned immediately adjacent to the free end of insulated hot contact plate 352. Thus, when the aforementioned electrical circuit is closed, current flows through filament wire 316 to heat the same, thereby causing filament wire 316 to emit light in normal operation. A guide cage 364 is provided in evacuated glass envelope 314 to guide first neutral filament wire 360 and second hot filament wire 362.

Figure 15:
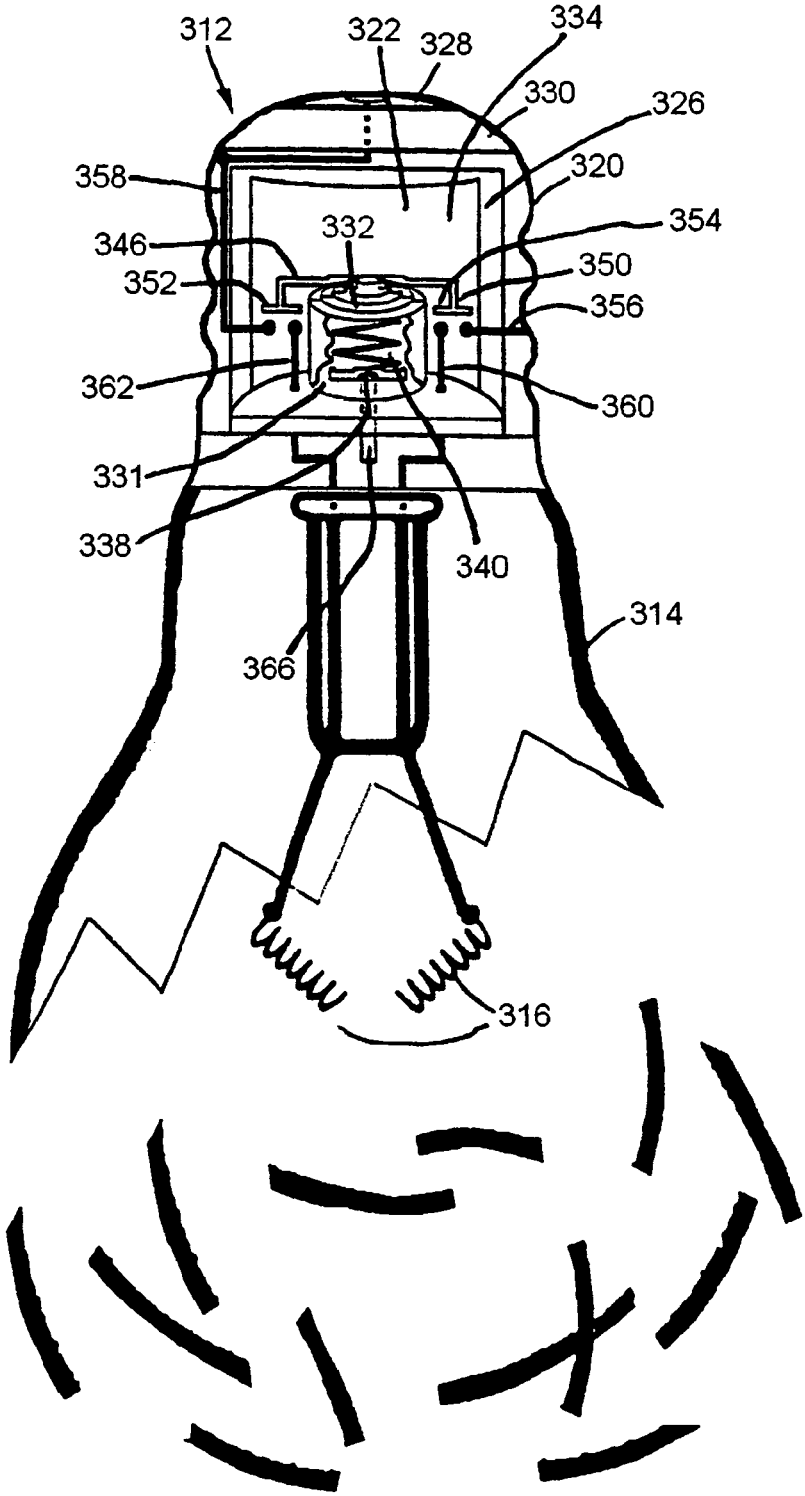
FIG. 15 is a cross-sectional view of the incandescent safety lightbulb of FIG. 13 after the glass has been shattered.
Figure 16:
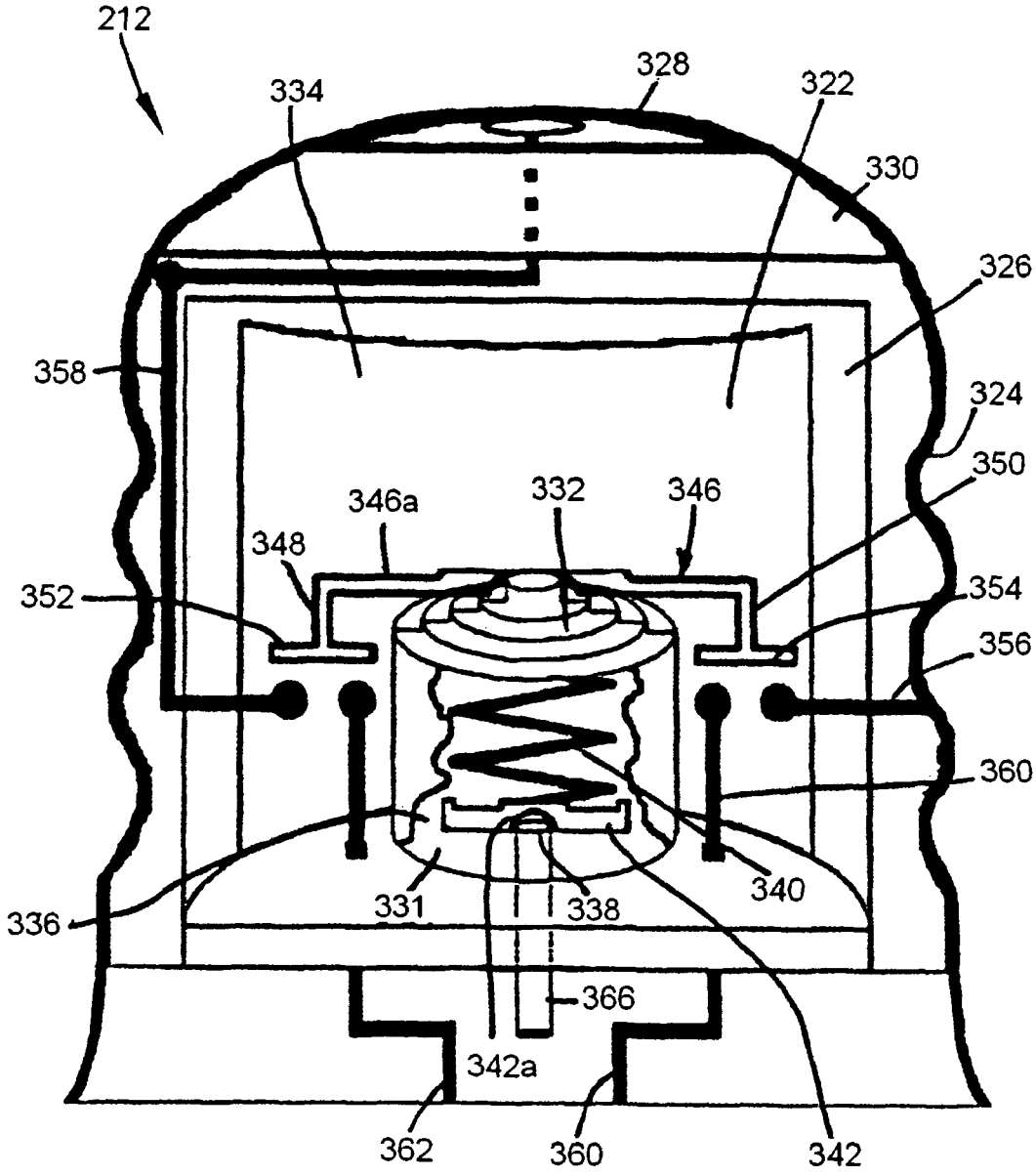
FIG. 16 is an enlarged cross-sectional view of the base of the incandescent safety lightbulb of FIG. 15.
Figure 17:
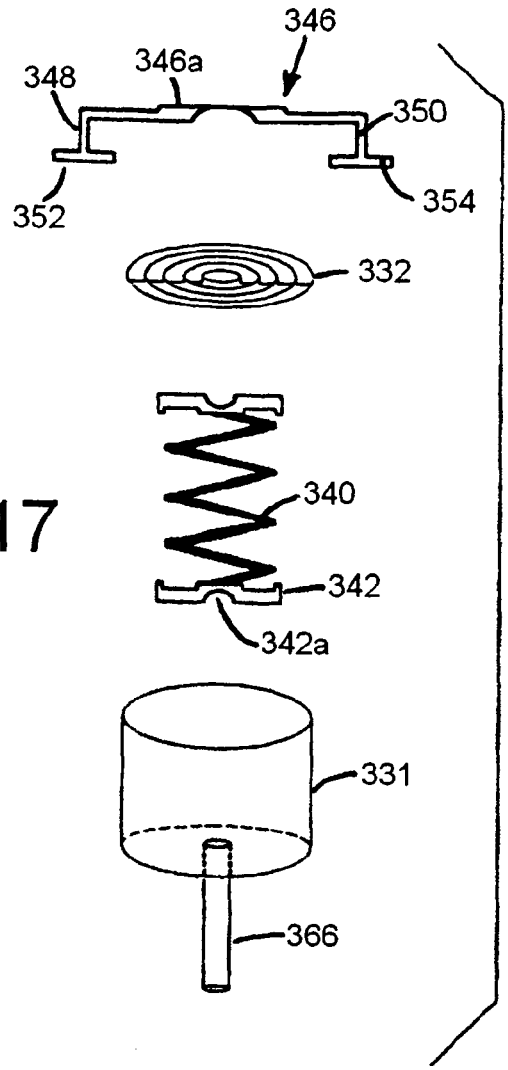
FIG. 17 is an exploded elevational view of the different safety parts in the base of the incandescent safety lightbulb of FIG. 13.

When evacuated glass envelope 314 breaks, as shown in FIGS. 15-17, with filament wire 362 broken as shown, or unbroken (not shown), second chamber 336 is now connected with ambient atmosphere through opening 338. At this time, the pressures in chambers 334 and 336 are equalized, so that flexible membrane 332 is no longer restrained, that is, membrane 332 is no longer biased in a direction toward wall 321 by this pressure differential, and therefore resumes its original, unbiased configuration due to its elastic memory. The moving of flexible membrane 332 is aided by coil spring 340. As a result, coil spring 340 further biases electrical contact member 346 and flexible membrane 332 in a direction toward electrically conductive end cap 328. This results in electrical contact plates 352 and 354 moving away from the free ends of insulated neutral wiring 356, insulated hot wiring 358, first neutral filament wire 360 and second hot filament wire 362. This causes the electrical circuit to open within base 312, so that no current can flow through first neutral filament wire 360, second hot filament wire 362 or filament 316, whereby no electric shock can be imparted to a person that accidentally touches filament 316 or wires 360 or 362.

In addition, a tube 366 can be inserted through opening 338, terminating at its upper end in opening 338 and extending down into glass envelope 314. This serves the purpose of hindering the transfer of heat from glass envelope 314 to second chamber 336.

It will be appreciated that variations of the above can be made by one skilled in the art. For example, flexible membrane 332 can be replaced by an accordion-type membrane at the upper end of housing 331. Alternatively, an according-type housing can surround housing 331 in order to provide further sealing and spring-like functions.

Thus, as shown in FIGS. 17A-17F, an incandescent lightbulb 1310 according to a fourth modification of the first embodiment of the present invention will now be described in which elements corresponding to those of FIGS. 13-17 are identified by the same reference numerals, augmented by 1000. Incandescent lightbulb 1310 is similar to incandescent lightbulb 310, but differs therefrom by eliminating spring 340 and providing a flexible accordion-type housing 1332 in place of flexible membrane 332 which can be made of a light sheet steel or other plastic or metal material.

Incandescent lightbulb 1310 includes a base 1312 and an evacuated glass envelope 1314 secured thereto, with a filament (not shown) contained in glass envelope 1314 and adapted to be heated so as to emit light.

Base 1312 includes a closed casing 1320 having a hollow interior chamber 1322. Casing 1320 is preferably made of an electrically conductive material, such as an electrically conductive metal which constitutes the neutral or ground electrical contact, and preferably has threads 1324 on the exterior surface for receipt in a threaded electrical socket (not shown). The inner surfaces of casing 1320 are preferably insulated with an insulating layer 1326. Further, base 1312 includes an electrically conductive end cap 1328 which constitutes the hot electrical contact, and which is connected to a non-threaded part of casing 1320 through an insulating layer 1330, so as to be electrically insulated from casing 1320.

Hollow interior chamber 1322 is divided by a non-collapsible housing 1331, which has its lower end fixed on a lower wall 1321 of casing 1320. Housing is closed at its upper end by a flexible accordion-type housing 1332. Flexible accordion-type housing 1332 can be made as a one-piece, integral assembly with housing 1331, or can be made separate therefrom and secured to an upper end of housing 1331. As a result, housing 1331 divides chamber 1322 into a first chamber 1334 within casing 1320 and outside of housing 1332, and a second chamber 1336 within housing 1332. First chamber 1334 is provided with air at a first pressure, which is preferably ambient atmosphere, while second chamber 1336 is in fluid communication with the interior of glass envelope 1314 through an opening 1338 in wall 1321 of casing 1320 so as to be effectively evacuated as well, and thereby, at a much reduced pressure in comparison to first chamber 1334. As a result, flexible housing 1332 is compressed and biased toward wall 1321 by the pressure differential between chambers 1334 and 1336, as shown in FIG. 17A.

The upper end of flexible accordion-type housing 1332 is fixed to the underside of a main body 13246*a* of an electrical contact member 1346 by any suitable means such as adhesive, welding or the like.

Electrical contact member 1346 includes two electrical contact arms 1348 and 1350 extending outwardly from main body 1346*a* and within first chamber 1334, with electrical contact plates 1352 and 1354 at the ends of contact arms 1348 and 1350, respectively. Insulated neutral wiring 1356 extends from the outer surface of casing 1320 at threads 1324 thereof into the interior of first chamber 1334 and has a contact end which terminates immediately adjacent electrical contact plate 1354, while insulated hot wiring 1358 extends from electrically conductive end cap 1328, through casing 1320 into the interior of first chamber 1334 and has a contact end which terminates immediately adjacent electrical contact plate 1352.

In this manner, as shown in FIG. 17A, when the pressure in first chamber 1334 is greater than that in second chamber 1336, flexible housing 1332 is biased toward wall 1321 so as to force electrical contact member 1346 in the same direction. As a result, electrical contact plates 1352 and 1354 are moved into contact with insulated hot wiring 1358 and insulated neutral wiring 1356 which extend into second chamber 1336, thereby closing the electrical circuit, whereby current flows therethrough.

A first neutral filament wire 1360 is connected to one end of the filament (not shown) and extends through wall 1321 of casing 1320 into first chamber 1334, with the opposite end thereof having a contact positioned immediately adjacent to the free end of insulated neutral wiring 1356 and immediately adjacent electrical contact plate 1354. In like manner, a second hot filament wire 1362 is connected to the opposite end of the filament and extends through wall 1321 of casing 1320 into first chamber 1334, with the opposite end thereof positioned immediately adjacent to the free end of insulated hot contact plate 1352. Thus, when the aforementioned electrical circuit is closed, current flows through the filament to heat the same, thereby causing the filament to emit light in normal operation.

When evacuated glass envelope 1314 breaks, as shown in FIG. 17B, with the filament (not shown) broken or unbroken, second chamber 1336 is now connected with ambient atmosphere through opening 1338. At this time, the pressures in chambers 1334 and 1336 are equalized, so that flexible accordion-type housing 1332 is no longer restrained, that is, flexible accordion-type housing 1332 is no longer biased in a direction toward wall 1321 by this pressure differential, and therefore, the equalization of pressure in chambers 1334 and 1336 causes flexible accordion-type housing 1332 to resume its original, unbiased configuration. This results in electrical contact plates 1352 and 1354 moving away from the free ends of insulated neutral wiring 1356, insulated hot wiring 1358, first neutral filament wire 1360 and second hot filament wire 1362. This causes the electrical circuit to open within base 1312, so that no current can flow through first neutral filament wire 1360, second hot filament wire 1362 or the filament, whereby no electric shock can be imparted to a person that accidentally touches the filament or wires 1360 or 1362.

Figure 18:
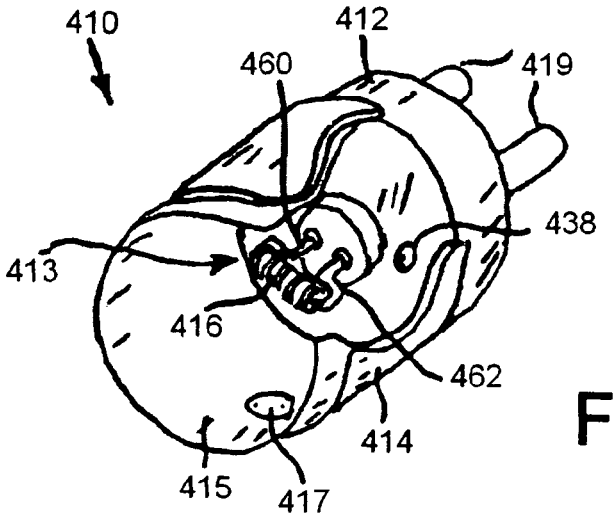
FIG. 18 is a cross-sectional view of a portion of a fluorescent safety lightbulb according to a modification of the first embodiment of the present invention.
Figure 19:
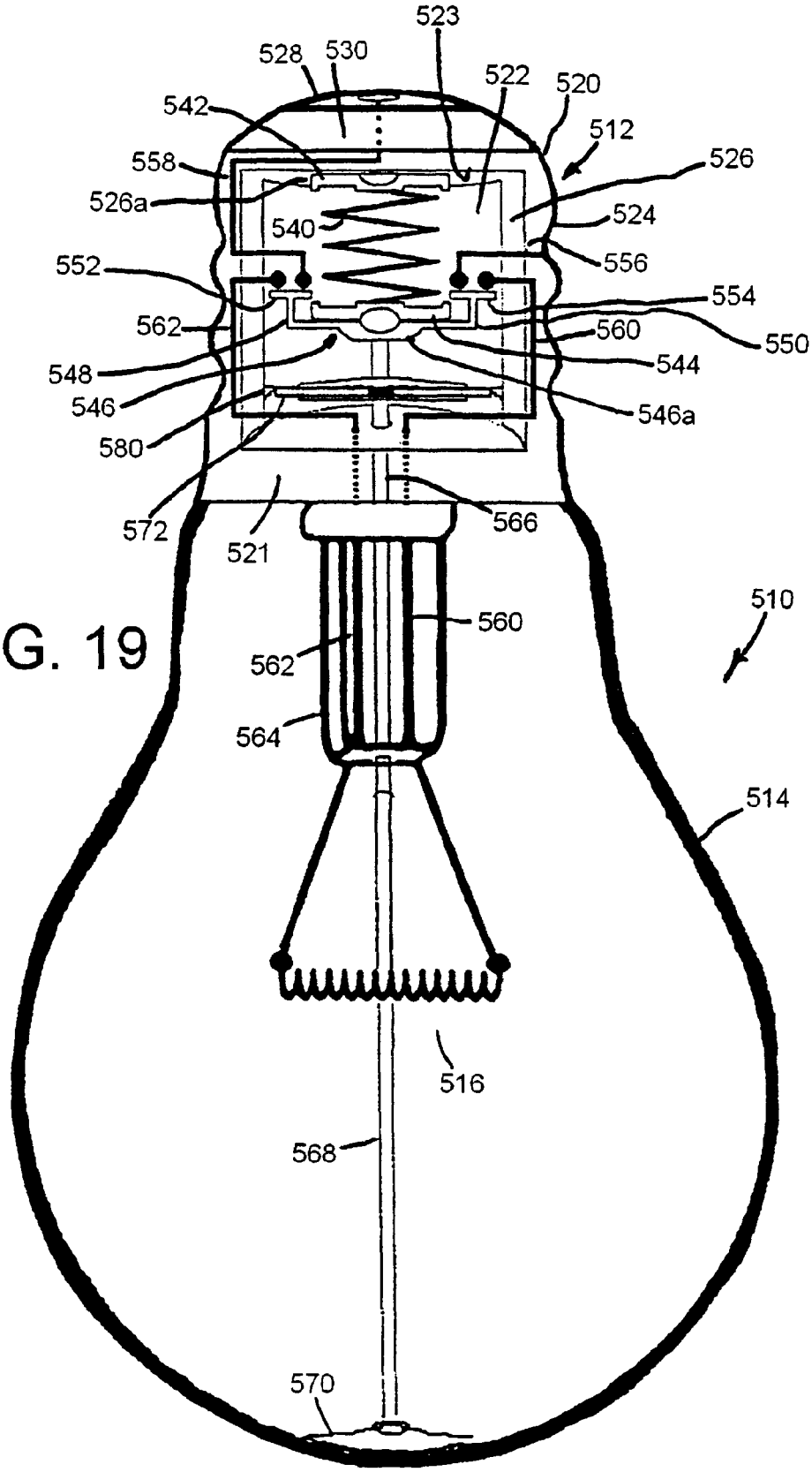
FIG. 19 is a cross-sectional view of an incandescent safety lightbulb according to a second embodiment of the present invention in its operative state.

It will be appreciated that, although the embodiments of FIGS. 1-17B have been discussed relative to an incandescent lightbulb 10, 110, 210, 310, 1310, the present invention can also be used in the same manner with a fluorescent lightbulb 410, as shown in the broken away view of FIG. 18.

Specifically, fluorescent lightbulb 410 includes opposing bases 412 at opposite ends of the lightbulb, as is well known, with a glass tube or envelope 414 connecting together the bases 412. Only one base 412 is shown in FIG. 18. An electrode 413 is formed at each base 412 and includes a filament 416, similar to that in an incandescent light bulb, which extends from each base 412 into the cavity of glass tube 414 and is connected at opposite ends thereof to a first neutral filament wire 460 and a second hot filament wire 462 extending from the base 412. Glass tube 414 is coated on the interior thereof with an internal phosphor coating 415, and mercury 417 is also provided therein. Contact pins 419 are provided on the exterior of each base 412 for electrical connection and for support in an appropriate electrical socket, as is well known. Thus, current passes through electrodes 413 at both bases 412 at the ends of tube 414. As a result, electricity heats up filaments 416. This boils off electrons from the metal surface, sending them into tube 414, ionizing the gas therein.

Each base 412 is provided with an arrangement which is identical to that of any of FIGS. 1-17. In this regard, base 412 is provided with an opening 438 which provides fluid communication between the internal cavity of glass tube 414 and the interior of base 412.

Since the internal cavity of glass tube 414 includes an inert gas, typically argon, kept under a very low pressure, if glass tube 414 breaks, the chamber in base 412 corresponding to the second chamber, for example, chamber 36 in FIG. 1, will then be connected to ambient atmosphere, in order to electrically disconnect first neutral filament wire 460 and a second hot filament wire 462 from the power source in the same manner as discussed above in regard to FIGS. 1-17.

It will be appreciated that with the phase-out of incandescent lightbulbs in the U.S. and other countries, fluorescent bulbs that screw into conventional incandescent lightbulb sockets have been developed, and therefore, the present invention is directed to such fluorescent lightbulbs in the same manner as described above. An example of such a fluorescent lightbulb is disclosed in U.S. Pat. No. 6,431,725, the entire disclosure of which is incorporated herein by reference, and the filament can be electrically disconnected upon breakage of the outer envelope and/or inner fluorescent tube therein.

It will be appreciated that various modifications can be made to the first embodiment, within the scope of the claims. For example, the coil spring can be a spring in second chamber 36 that pulls membrane 32 in a direction toward end cap 28, but which force is overcome in a normal operating environment by the pressure differential in chambers 34 and 36. In such case, when glass envelope 14 breaks, the coil spring would aid membrane 32 to move in a direction toward end cap 28. Effectively, the spring would be a pulling spring, rather than a pushing spring 40, as in FIGS. 1 and 2.

Referring now to FIGS. 19-22, an incandescent lightbulb 510 according to a second embodiment of the present invention will now be described in which elements corresponding to those of FIGS. 1 and 2 are identified by the same reference numerals, augmented by 500.

As shown therein, incandescent lightbulb 510 according to the second embodiment of the present invention includes a base 512 and an evacuated glass envelope 514 secured thereto, with a filament 516 contained in glass envelope 514 and adapted to be heated so as to emit light.

Base 512 includes a closed casing 520 having a hollow interior chamber 522. Casing 520 is preferably made of an electrically conductive material, such as an electrically conductive metal which constitutes the neutral or ground electrical contact, and preferably has threads 524 on the exterior surface for receipt in a threaded electrical socket (not shown). The inner surfaces of casing 520 are preferably insulated with an insulating layer 526. Further, base 512 includes an electrically conductive end cap 528 which constitutes the hot electrical contact, and which is connected to a non-threaded part of casing 520 through an insulating layer 530, so as to be electrically insulated from casing 520.

A coil spring 540 is interposed between an upper end wall 523 of casing 520 adjacent end cap 528 and a main body 546*a* of an electrical contact member 546, and applies a biasing force on electrical contact member 546 in a direction toward filament 516. In this regard, a first coil spring holder 542 is provided in a recess 526*a* of insulating wall 526 and against wall 523 for holding or restraining a first end of coil spring 540. In like manner, a second coil spring holder 544 is provided for holding or restraining the opposite, second end of coil spring 540, and is fixed to main body 546*a* of an electrical contact member 546 by any suitable means, such as adhesive, welding or the like. In this regard, coil spring 540 is restrained to only move axially.

Electrical contact member 546 includes two electrical contact arms 548 and 550 extending outwardly from main body 546*a* and within first chamber 534, with electrical contact plates 552 and 554 at the ends of contact arms 548 and 550, respectively. Insulated neutral wiring 556 extends from the outer surface of casing 520 at threads 524 thereof into the interior of chamber 522 and has a contact end which terminates immediately adjacent electrical contact plate 554, while insulated hot wiring 558 extends from electrically conductive end cap 528, through casing 520 into the interior of chamber 522 and has a contact end which terminates immediately adjacent electrical contact plate 552.

In this manner, when electrical contact member 546 is moved toward wall 523 and end cap 528, electrical contact plates 552 and 554 are moved into contact with insulated hot wiring 558 and insulated neutral wiring 556 which extend into chamber 522, thereby closing the electrical circuit, whereby current flows therethrough.

A first neutral filament wire 560 is connected to one end of filament 516 and extends through an opposite wall 521 of casing 520 and then into chamber 522, with the opposite end thereof having a contact positioned immediately adjacent to the free end of insulated neutral wiring 556 and immediately adjacent electrical contact plate 554. In like manner, a second hot filament wire 562 is connected to the opposite end of filament 516 and extends through wall 521 of casing 520 into chamber 522, with the opposite end thereof positioned immediately adjacent to the free end of insulated hot contact plate 552. Thus, when the aforementioned electrical circuit is closed, current flows through filament wire 516 to heat the same, thereby causing filament wire 516 to emit light in normal operation. A guide cage 564 is provided in evacuated glass envelope 514 to guide first neutral filament wire 560 and second hot filament wire 562.

A stub tube 566 slidably extends centrally within guide cage 564, through wall 521 and into contact with one surface of electrical contact member 546. The essence of the second embodiment is a tube or rod 568 which has one end that extends into contact with stub tube 566 and an opposite end that extends centrally in a plate member 570 that is positioned against the inner surface of glass envelope 514. With this arrangement, rod 568 functions to bias electrical contact member 546 in a direction against the force of coil spring 540, through the intermediaries of stub tube 566. As a result, in normal operation, electrical contact member 546 is biased in a direction toward end cap 528, so that electrical contact plates 552 and 554 contact insulated hot wiring 558, second hot filament wire 562, insulated neutral wiring 556 and first neutral filament wire 560 in order to complete the circuit and illuminate the bulb.

Figure 20:
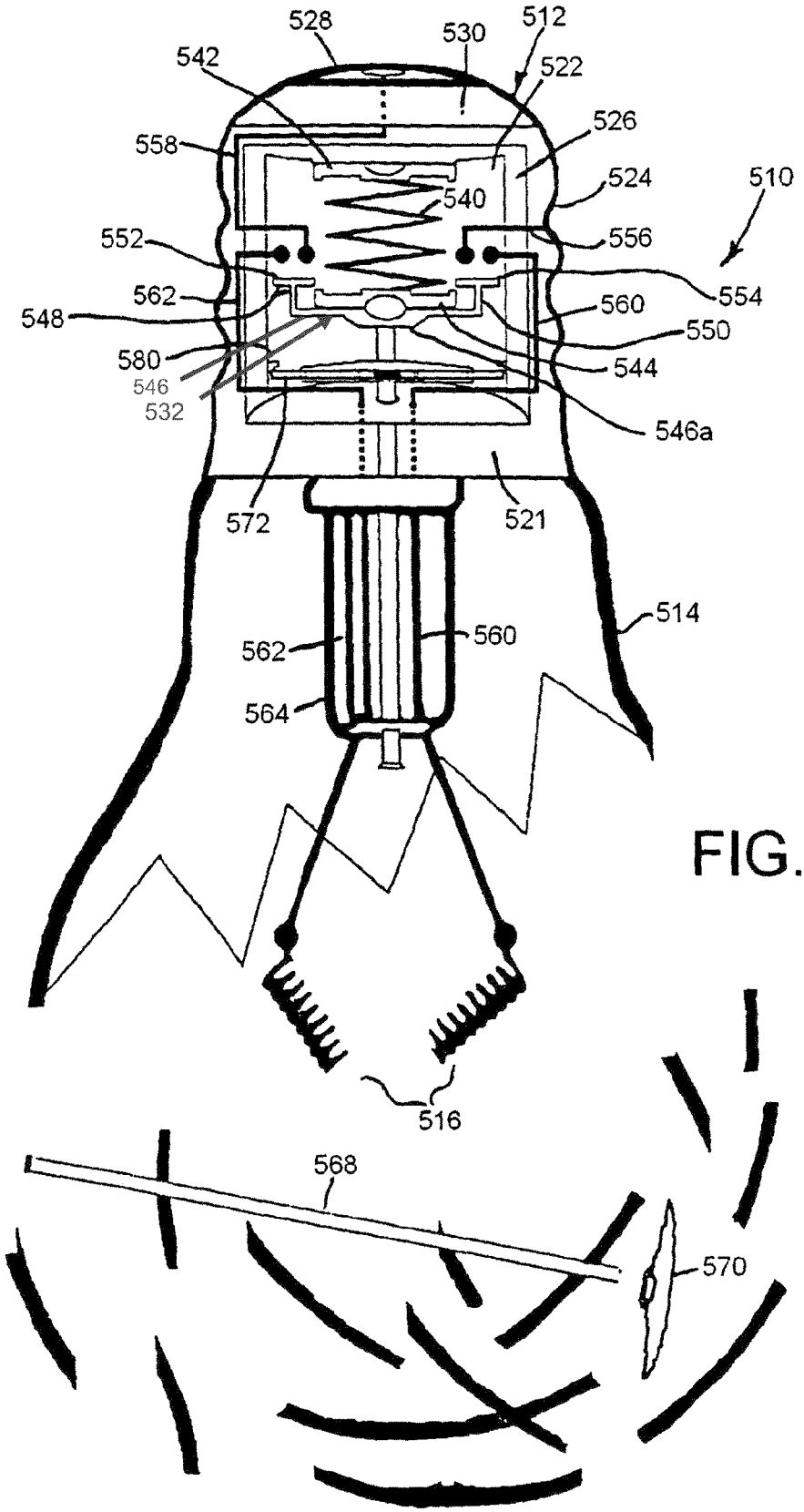
FIG. 20 is a cross-sectional view of the incandescent safety lightbulb of FIG. 19 after the glass has been shattered.

However, as shown in FIG. 20, when glass envelope 514 shatters, rod 568 is no longer held by glass envelope 514 and falls down. As a result, electrical contact member 546 is no longer restrained, so that coil spring 540 biases electrical contact member 546 in a direction toward wall 521 in order to move electrical contact plates 552 and 554 out of electrical contact with insulated hot wiring 558, second hot filament wire 562, insulated neutral wiring 556 and first neutral filament wire 560, whereby to disconnect or open the electrical circuit, so that no electric shock can be imparted to a person that accidentally touches filament 516.

However, with this embodiment, there is still a possibility that a person can push on stub tube 566, causing electrical contact member 546 to move upwardly and again complete the circuit, which would be dangerous.

In order to prevent this occurrence, as best shown in FIGS. 20-22, two rods 572 slidably extend out from opposite ends of a spring housing 574 that is connected with stub tube 566. The two rods 572 are biased outwardly by a spring 576 therebetween located in spring housing 574. The inner surface of insulating layer 526 includes two projections 580, each having steps 582 facing away from membrane 532. The rods 572 are biased into engagement with a respective one of the steps 582 of each projection 580, and depending upon which step 582 is engaged, will determine the position of electrical contact member 546. Thus, in the normal operating condition, as shown in FIG. 21, the rods 572 are positioned between projections 580. However, when the glass envelope 514 shatters and electrical contact member 546 is moved down by spring 540, stub tube 566 and spring housing 574 are moved down therewith. At this point, the ends of rods 572 are biased outwardly to engage a lower step 582, as shown in FIG. 22. Then, if a person attempts to push up on stub tube 566, stub tube 566 is restrained by rods 572 engaging with lower steps 582 to prevent electrical contact.

It will be appreciated that various modifications can be made to lightbulb 510 within the scope of the claims. For example, a flexible membrane similar to membrane 32 of FIG. 1 can be added, and which is fixed to the underside of electrical contact member 546.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A safety lightbulb comprising:

a base, a glass envelope connected to said base, at least one electrical contact extending from said base into said glass envelope, an arrangement for producing light in said glass envelope when current is supplied to said at least one electrical contact from a power source to which the base is connected, a safety arrangement in said base which automatically electrically disconnects said at least one electrical contact from the power source when said glass envelope is broken, wherein said safety arrangement includes an electrical contact member in said base and which is moved out of electrical contact with at least one of:

the power source, and at least one said electrical contact when said glass envelope is broken, wherein said power source includes at least one electrical power lead extending into said base, wherein said safety arrangement includes a moving/restraining arrangement in said base for moving said electrical contact member out of electrical contact with at least one of:

at least one said electrical power lead, and at lease one said electrical contact, when said glass envelope is broken, and wherein said moving/restraining arrangement includes a rod having one end in contact with an inner surface of said glass envelope and an opposite end which maintains said electrical contact member in electrical contact with at least one of:

at least one electrical power lead, and at least one said electrical contact, during normal operation of said safety lightbulb when said glass envelope is unbroken.

2. A safety lightbulb according to claim 1, wherein said safety arrangement further includes a spring in said base which functions to bias said electrical contact member with a spring force in a direction to move said electrical contact member out of electrical contact with at least one of:

at least said electrical power lead, and at least one said electrical contact, when said glass envelope is broken and said rod no longer applies a force on said electrical contact member, but which spring force is less than a force applied in an opposite direction by said rod.

3. A safety lightbulb according to claim 1, further including a stub tube that slidably extends through a wall of said base which separates said base and said glass envelope, said stub tube having a first end engaging said electrical contact member, and said rod includes a first end in engagement with the inner surface of said glass envelope and a second end in engagement with said first end of said stub tube to move said stub tube in a direction into said base so as to maintain said electrical contact member in electrical contact with at least one of at least one electrical power lead, and at least one said electrical contact, during normal operation of said safety lightbulb when said glass envelope is unbroken.

4. A safety lightbulb according to claim 3, further comprising a second safety arrangement for preventing sliding movement of said stub tube into said base when said lightbulb is broken.

5. A safety lightbulb according to claim 4, wherein said second safety arrangement includes:

a safety housing connected with said stub tube, at least one transverse rod slidably mounted in said safety housing and having an end extending out of said safety housing, a biasing arrangement for biasing said at least one transverse rod in a direction out of said safety housing, and at least one arrangement having a first engagement surface at an inner surface of said base and a second engagement surface at said inner surface of said base and which is positioned radially outwardly of said first engagement surface, said second engagement surface being positioned closer to said glass envelope than said first engagement surface, wherein said end of said at least one transverse rod is engaged with said first engagement surface when said glass envelope is unbroken, and wherein movement of said stub tube in a direction toward said glass envelope when said glass envelope breaks and said rod falls away from the stub tube causes said safety housing to move in a direction toward said glass envelope such that said biasing arrangement moves said at least one transverse rod into engagement with said second engagement surface, thereby preventing return movement of said stub tube in a direction into said base.

6. A safety lightbulb according to claim 5, wherein said at least one arrangement includes at least one projection extending inwardly from an inner wall of said base, each said projection including a stepped surface facing said glass envelope, and said at least one projection with said stepped surface forming said first and second engagement surfaces.

* * * * *